US008032043B2

(12) United States Patent
Nakayama et al.

(10) Patent No.: US 8,032,043 B2
(45) Date of Patent: Oct. 4, 2011

(54) IMAGE FORMING APPARATUS AND IMAGE FORMING METHOD

(75) Inventors: Kanji Nakayama, Toyokawa (JP); Noritoshi Hagimoto, Toyohashi (JP); Yuusuke Okuno, Toyokawa (JP); Tomo Kitada, Toyokawa (JP); Toshiya Aoki, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 306 days.

(21) Appl. No.: 12/478,055

(22) Filed: Jun. 4, 2009

(65) Prior Publication Data

US 2009/0310995 A1 Dec. 17, 2009

(30) Foreign Application Priority Data

Jun. 17, 2008 (JP) ..... 2008-158467

(51) Int. Cl.
*G03G 15/06* (2006.01)

(52) U.S. Cl. ..... 399/55

(58) Field of Classification Search ..... 399/55, 399/53, 285

See application file for complete search history.

(56) References Cited

U.S. PATENT DOCUMENTS

2004/0005160 A1* 1/2004 Kawamura et al. ..... 399/55

FOREIGN PATENT DOCUMENTS

| | | |
|---|---|---|
| JP | 2000-122411 | 4/2000 |
| JP | 2001-075341 A | 3/2001 |
| JP | 2005-055468 | 3/2005 |
| JP | 2006-285201 | 10/2006 |

OTHER PUBLICATIONS

Decision of Grant issued Apr. 13, 2010 in the corresponding Japanese Patent Application No. 2008-158467 and an English translation thereof.

* cited by examiner

*Primary Examiner* — Susan Lee
(74) *Attorney, Agent, or Firm* — Buchanan Ingersoll & Rooney PC

(57) ABSTRACT

In case new and old toners may be mixed, a developing bias is set as follows. The time is first clocked. The number of times toner is replenished from a hopper into a buffer for a clocked period is counted. If a replenishment amount per clock time is a threshold value or higher, considering that new and old toners are mixed, the setting of the developing bias is changed. An electric field intensity between a developing roller and a photoconductor is set to cause normally-charged toner to fly in an image area but not to fly in a background area. No image fogging is therefore generated in the background area. Thus, an image forming apparatus and method capable of preventing low-charged toner and oppositely-charged toner generated by mixing of new and old toners from adhering to the background area of an electrostatic latent image on the photoconductor, thereby avoiding generation of image fogging.

14 Claims, 13 Drawing Sheets

IMAGE FORMING APPARATUS AND IMAGE FORMING METHOD

This application is based upon and claims the benefit of priority from the prior Japanese Patent Application No. 2008-158467 filed on Jun. 17, 2008, the entire contents of which are incorporated herein by reference.

TECHNICAL FIELD

The present invention relates to an image forming apparatus of a non-contact developing type using non-magnetic mono-component toner, and an image forming method. Particularly, the present invention relates to an image forming apparatus and method capable of adjusting a developing bias to prevent image fogging caused by low-charged toner and oppositely-charged toner.

BACKGROUND ART

An image forming apparatus is arranged to form an electrostatic latent image on the surface of a photoconductor and giving toner to the electrostatic latent image for development. An example thereof is described below. Firstly, a photoconductor is charged by a charging device and then the charged surface of the photoconductor is partly exposed by an exposure device to form an electrostatic latent image. Then, a developing bias is applied to attract the toner from a developing roller onto the electrostatic latent image on the photoconductor. Accordingly, it is important for ensuring the quality of a printed material to cause a needed amount of toner to exactly or faithfully adhere to the electrostatic latent image in order to output clear and appropriately dark printed images. It is therefore preferable that the toner has an appropriate charge quantity.

In the image forming apparatus, however, the charging characteristics of toner stored in a buffer will change with time because the toner deteriorate due to repeated friction with a restriction blade, a supply roller, and others. At an initial stage, toner has good charging characteristics and little variation in charge quantity. This toner is charged by the restriction blade for development to have an appropriate charge quantity and is attracted onto the developing roller (hereinafter, referred to as "normally-charged toner"). On the other hand, the toner becomes hard to be charged due to some causes, for example, when an external additive comes off due to friction. This generates toner having a low charge quantity (hereinafter, referred to as "low-charged toner"). This low-charged toner may adhere to the background area of the electrostatic latent image to which the toner actually should not adhere. This results in image fogging during printing, leading to degradation in the quality of a printed material. Furthermore, as deterioration of the toner further progresses, some toner particles come to be charged oppositely to the normally-charged toner (hereinafter, referred to as "oppositely-charged toner"). The oppositely-charged toner tends to adhere to the background area rather than to the image area.

When images are continuously printed at high coverage (high printing rate), the toner in the buffer is consumed at once and accordingly a large volume of new toner is added into the buffer at a time. Thus, newly added toner and deteriorated toner are mixed. Due to this mixing of new and old toners, toner charge quantity distribution is broadened. This distribution is broader not only than the case of only new toner but also than the case of only deteriorated toner. In other words, a ratio of normally charged toner decreases, and ratios of the toner having a higher charge quantity than the normally-charged toner, the low-charged toner, and the oppositely-charged toner increase. The oppositely-charged toner may be electrically connected with the normally-charged toner to form combined toner. Such combined toner may also cause image fogging. To facilitate separation of the combined toner, therefore, Patent Literature 1 discloses a developing apparatus arranged to adjust, for a fixed period after toner is replenished, at least one of frequency and amplitude of an alternate current component of a developing bias to be larger than a condition for normal image formation.

CITATION LIST

Patent Literature

Patent Literature 1: JP2001-75341A

SUMMARY OF INVENTION

Technical Problem

The image forming apparatus disclosed in Patent Literature 1 is configured to separate the combined toner to the normally-charged toner and the oppositely-charged toner. However, even if the normally-charged toner and the oppositely-charged toner are separated, the oppositely-charged toner originally tends to adhere to a background area of an electrostatic latent image. It is thus impossible to prevent the oppositely-charged toner from adhering thereto. Furthermore, the means described in Patent Literature 1 could not prevent the low-charged toner from adhering to the background area.

The present invention has been made to solve the aforementioned problems and has a purpose to provide an image forming apparatus capable of preventing low-charged toner and oppositely-charged toner generated when new and old toners are mixed from adhering to a background area of an electrostatic latent image on a photoconductor, thereby restraining the occurrence of image fogging.

Solution to Problem

To achieve the above purpose, according to one aspect of the present invention, there is provided an image forming apparatus of non-contact developing type, the apparatus comprising: an image carrier; a developing roller for giving non-magnetic mono-component toner to the image carrier; a supply roller for supplying the toner to the developing roller; a buffer for storing and agitating the toner to be supplied to the supply roller; a hopper for storing the toner to be replenished into the buffer; and a voltage application section for applying a developing bias between the image carrier and the developing roller, wherein the voltage application section applies, as the bias voltage, developing voltage Vmin for forming an electric field in a direction that causes the toner to fly from the developing roller to the image carrier and a collecting voltage Vmax for forming an electric field in a direction that collects the toner from the image carrier to the developing roller so that the developing voltage and the collecting voltage are alternately repeatedly applied, and the developing voltage Vmin is set to a first value when an accumulated replenishment rate determination value SRin is a positive value, the accumulated replenishment rate determination value SRin being obtained by the following expression:

$$SRin=\Sigma(Rin-Rth)$$

$$Rin=Nr\times Rep/ITr$$

where

"Nr" is the number of times toner is replenished within a clocking time of preset length, "Rep" is an amount of toner to be replenished each time, "ITr" is the length of the preset clocking time, "Rth" is a value set as a replenishment rate at which toner can be agitated sufficiently, a start point of the sum is the time when a value of (Rin−Rth) becomes positive, and an end point of the sum is the time when SRin becomes equal to or smaller than zero (SRin≦0), the first value being a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and the developing voltage Vmin is set to a second value when the accumulated replenishment rate determination value SRin is a negative value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

According to another aspect of the present invention, there is provided an image forming method employed by an image forming apparatus of non-contact developing type comprising an image carrier, a developing roller for giving non-magnetic mono-component toner to the image carrier, a supply roller for supplying the toner to the developing roller, a buffer for storing and agitating the toner to be supplied to the supply roller, and a hopper for storing the toner to be replenished into the buffer, the image forming method comprising: applying a developing bias between the image carrier and the developing roller is alternately repeated between a developing voltage Vmin for forming an electric field in a direction that causes the toner to fly from the developing roller to the image carrier, and a collecting voltage Vmax for forming an electric field in a direction that collects the toner from the image carrier to the developing roller, setting the developing voltage Vmin to a first value when an accumulated replenishment rate determination value SRin is a positive value, the accumulated replenishment rate determination value SRin being obtained by the following expression:

$$SRin=\Sigma(Rin-Rth)$$

$$Rin=Nr\times Rep/ITr$$

where

"Nr" is the number of times toner is replenished within a clocking time of preset length, "Rep" is an amount of toner to be replenished each time, "ITr" is the length of the preset clocking time, "Rth" is a value set as a replenishment rate at which toner can be agitated sufficiently, a start point of the sum is the time when a value of (Rin−Rth) becomes positive, and an end point of the sum is the time when SRin becomes equal to or smaller than zero (SRin≦0), wherein the first value is a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and to a second value when the accumulated replenishment rate determination value SRin is a negative value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

According to the image forming apparatus and method, it is possible to prevent the low-charged toner and the oppositely-charged toner generated when new toner and old toner are mixed from adhering to a background area of an electrostatic latent image. Further, the low-charged toner and the oppositely-charged toner will not be accumulated in the buffer. This makes it possible to prevent the generation of image fogging for a long period.

According to another aspect of the invention, there is provided an image forming apparatus of non-contact developing type, the apparatus comprising: an image carrier; a developing roller for giving non-magnetic mono-component toner to the image carrier; a supply roller for supplying the toner to the developing roller; a buffer for storing and agitating the toner to be supplied to the supply roller; a hopper for storing the toner to be replenished into the buffer; and a voltage application section for applying a developing bias between the image carrier and the developing roller, wherein the voltage application section applies, as the bias voltage, a developing voltage Vmin for forming an electric field in a direction that causes the toner to fly from the developing roller to the image carrier and a collecting voltage Vmax for forming an electric field in a direction that collects the toner from the image carrier to the developing roller so that the developing voltage and the collecting voltage are alternately repeatedly applied, and the developing voltage Vmin is set to a first value under a first condition that a replenishment amount of toner from the hopper into the buffer per preset time is higher than a threshold value, the first value being a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and to a second value under a second condition that the replenishment amount of toner from the hopper into the buffer per preset time is lower than the threshold value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

According to another aspect of the invention, there is provided an image forming method employed by the image forming apparatus of non-contact developing type comprising: an image carrier; a developing roller for giving non-magnetic mono-component toner to the image carrier; a supply roller for supplying the toner to the developing roller; a buffer for storing and agitating the toner to be supplied to the supply roller; and a hopper for storing the toner to be replenished into the buffer, the image forming method comprising: applying a developing bias between the image carrier and the developing roller is alternately repeated between a developing voltage Vmin for forming an electric field in a direction that causes the toner to fly from the developing roller to the image carrier, and a collecting voltage Vmax for forming an electric field in a direction that collects the toner from the image carrier to the developing roller, and setting the developing voltage Vmin to a first value under a first condition that a replenishment amount of toner from the hopper into the buffer per preset time is higher than a threshold value, the first value being a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and to a second value under a second condition that the replenishment amount of toner from the hopper into the buffer per preset time is lower than the threshold value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

According to this image forming apparatus and method, similarly, it is possible to prevent the low-charged toner and the oppositely-charged toner generated when new toner and old toner are mixed from adhering to a background area of an electrostatic latent image. Further, the low-charged toner and the oppositely-charged toner will not be accumulated in a buffer. This makes it possible to prevent the generation of image fogging for a long period. In the following description, the term "image area" also includes a clearance between the developing roller and (a surface of) the image carrier (a photoconductor) corresponding to the image area of the electrostatic latent image and the term "background area" also includes a clearance between the developing roller and (a surface of) the image carrier (the photoconductor) corresponding to the background area of the electrostatic latent image.

Advantageous Effects of Invention

The present invention can provide an image forming apparatus and method capable of preventing low-charged toner and oppositely-charged toner generated when new and old toners are mixed from adhering to a background area of an electrostatic latent image on a photoconductor and thus restraining occurrence of image fogging of the background area.

DESCRIPTION OF EMBODIMENTS

First Embodiment

A detailed description of a preferred embodiment of the present invention will now be given referring to the accompanying drawings.

<Apparatus Configuration>

Figure 1:
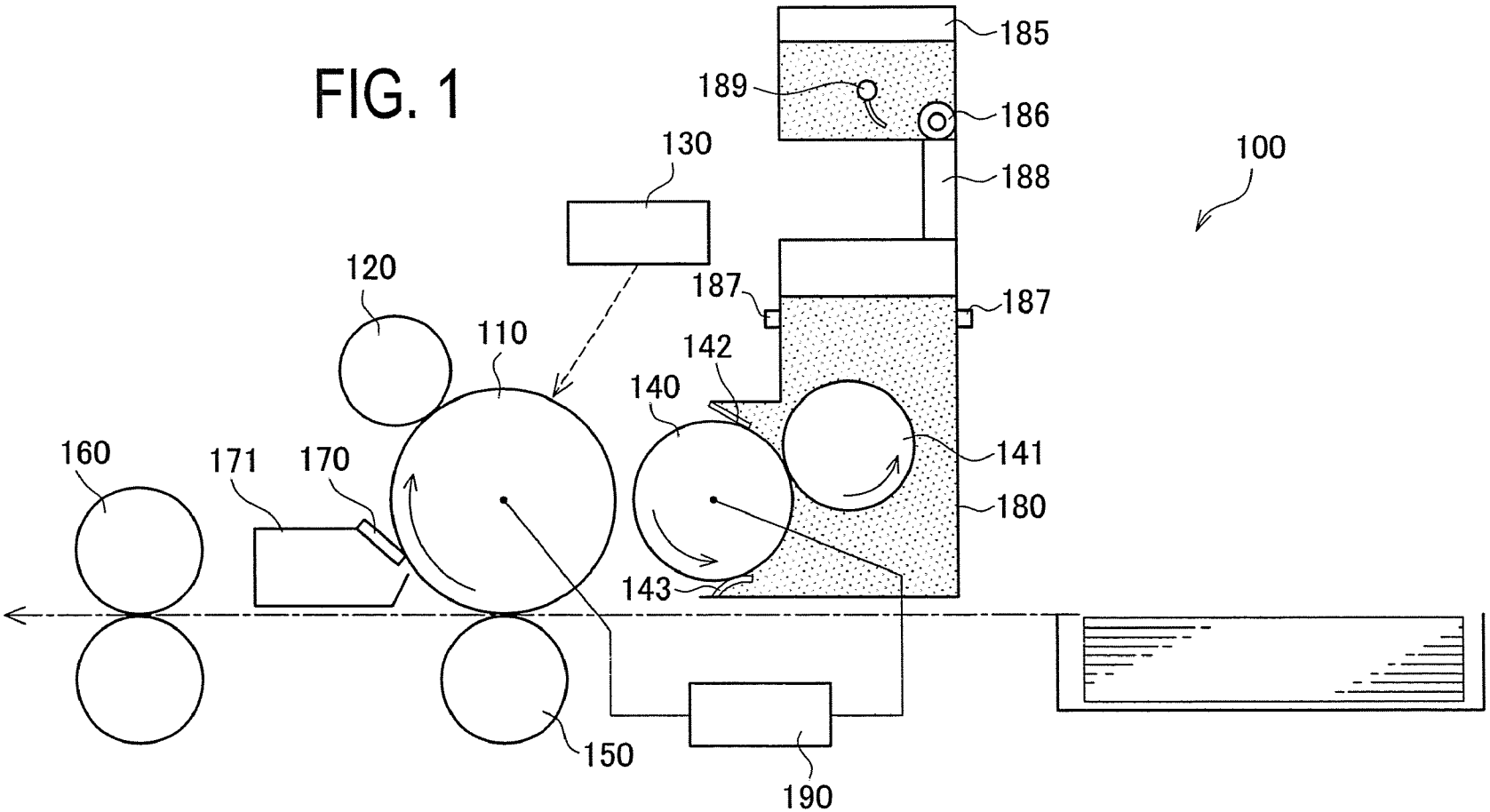
FIG. 1 is a view showing a mechanical configuration of an image forming apparatus of a preferred embodiment.
Figure 2:
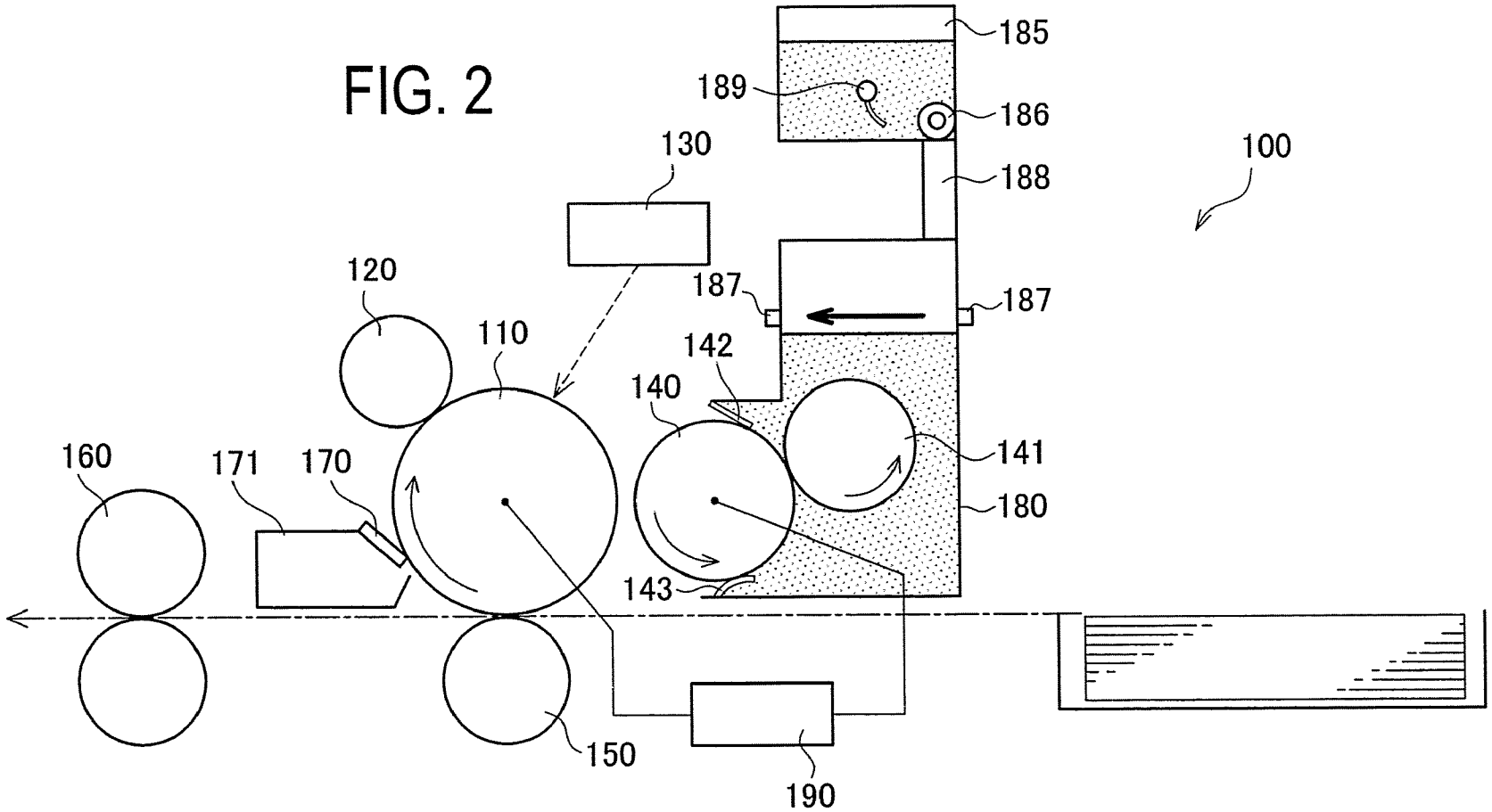
FIG. 2 is another view showing the image forming apparatus in which toner has been consumed.

A mechanical configuration of an image forming apparatus of this embodiment is explained with reference to FIG. 1. An image forming apparatus 100 includes a photoconductor 110, a charging device 120, an exposure device 130, a developing roller 140, a supply roller 141, a restriction blade 142, a neutralization sheet 143, a transfer unit 150, a fuser unit 160, a cleaner 170, a toner collecting container 171, a buffer 180, a hopper 185, a supply screw (hereinafter, simply "screw") 186, a level sensor 187, a supply pipe 188, an agitator member 189, and a voltage application section 190.

The photoconductor 110 is an image carrier of a cylindrical shape having a surface on which an electrostatic latent image is to be formed. The charging device 120 is used to uniformly charge the surface of the photoconductor 110. The exposure device 130 is used to apply light to the uniformly charged surface of the photoconductor 110 to form an electrostatic latent image thereon. The developing roller 140 is used to give toner to the electrostatic latent image on the photoconductor 110.

The image forming apparatus 100 of this embodiment performs development in a non-contact developing manner in which the photoconductor 110 and the developing roller 140 are placed in non-contact relation. Accordingly, the developing roller 140 is disposed to be slightly offset from the photoconductor 110 so as not to contact therewith. Furthermore, the image forming apparatus 100 is configured to apply a developing bias between the photoconductor 110 and the developing roller 140. Application and control of this developing bias is conducted by the voltage application section 190.

The supply roller 141 is used to supply the toner stored in the buffer 180 to the developing roller 140 and also serves to collect undeveloped toner from the surface of the developing roller 140. Thus, the supply roller 141 is rotated in an opposing direction against the rotation of the developing roller 140. The supply roller 141 is made of a foamed elastic member.

The restriction blade 142 is used to further charge the toner supplied to the developing roller 140 while controlling or metering the amount of toner to be fed. The buffer 180 is a container for storing toner. The hopper 185 is used to supply new toner after the toner stored in the buffer 180 is consumed. The supply screw 186 is operated to replenish the toner from the hopper 185 into the buffer 180. The level sensor 187 detects that an amount of toner in the buffer 180 decreases to a fixed amount or lower for the purpose of the timing and amount control of toner to be supplied from the hopper 185 into the buffer 180 through the supply pipe 188. Furthermore, the neutralization sheet 143 is placed to enhance a collect rate of residual toner after development.

The transfer unit 150 is used to transfer the toner on the electrostatic latent image on the surface of the photoconductor 110 to a paper. The cleaner 170 is used to collect the toner remaining on the surface of the photoconductor 110 into the toner collecting container 171 after the transfer of toner to the paper. The fuser unit 160 is used to fix the toner onto the paper to prevent the toner from coming off the paper.

A clearance between the photoconductor 110 and the developing roller 140 is about 130 μm. The toner adhering to the surface of the developing roller 140 is caused to fly across the clearance by the developing bias and finally adhere to the surface of the photoconductor 110.

<Operations of the Apparatus>

Herein, a series of operations of the image forming apparatus 100 of this embodiment is explained below. Firstly, the surface of the photoconductor 110 is uniformly charged by the charging device 120. Secondly, an electrostatic latent image is formed on the surface of the photoconductor 110 by the exposure device 130. The potential of the surface of the photoconductor 110 formed with the electrostatic latent image is different between the image area and the background area.

Then, the toner on the developing roller 140 is attracted to the electrostatic latent image on the surface of the photoconductor 110. At this development step, the toner adheres to the image area of the electrostatic latent image but does not adhere to the background area of the electrostatic latent image. This is because the developing bias has been set as mentioned later. Thus, the development can be made properly without causing image fogging.

Successively, the toner is transferred from the surface of the photoconductor 110 to the paper by the transfer unit 150. An image of the toner transferred onto the paper is fixed by the fuser unit 160. This can prevent the printed toner from coming off the paper. In the above way, the printing is conducted on the paper. On the other hand, the untransferred toner remaining on the surface of the photoconductor 110 is collected by the cleaner 170.

By the above development, the toner in the buffer 180 is consumed. To enable continuous image printing, new toner is then replenished into the buffer 180. When the toner in the buffer 180 is consumed and decreased, the toner existing between a light emitting element and a light receiving element of the level sensor 187 disappears. Accordingly, the light receiving element of the level sensor 187 detects the light from the light emitting element and accordingly the screw 186 is started to rotate, thereby the toner is supplied from the hopper 185 to the buffer 180. A relationship between the detection state of the level sensor 187 and the rotation time of the screw 186 is shown in FIG. 3.

Figure 3:
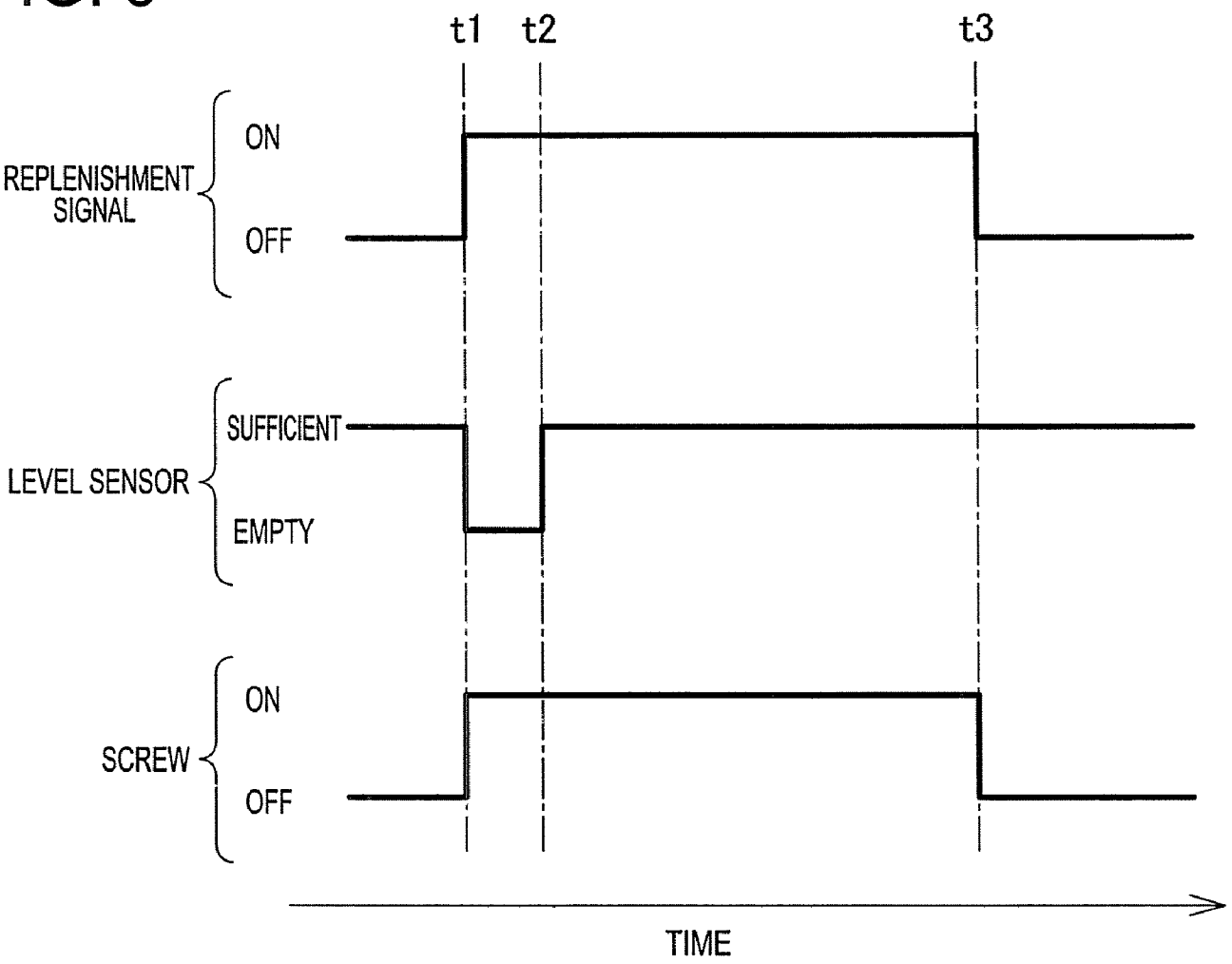
FIG. 3 is a timing chart showing a relationship between a level sensor and toner replenishment.

In FIG. 3, a lateral axis indicates time. At time t1, the signal of the level sensor 187 changes from "SUFFICIENT" to "EMPTY". At this time, a replenishment signal is also turned from OFF to ON. The screw 186 is rotated. This rotation makes the toner in the hopper 185 to be supplied into the buffer 180.

At time t2, subsequently, the signal of the level sensor 187 changes to "SUFFICIENT". However, even when the sensor signal changes, toner supply is not immediately stopped. The signal from the level sensor 187 indicates only whether or not the toner is stored in the buffer 180 up to the position (the height) of the level sensor 187 attached to the buffer 180, but does not indicate whether or not the buffer 180 is full with toner of allowable amount. Even after the level sensor 187 terminates outputting of the signal "EMPTY", therefore, toner can be further supplied by an amount corresponding to the volume of the part of the buffer 180 beyond the position of the level sensor 187.

Accordingly, the rotation of the screw 186 is continued up to time t3. The amount of toner to be supplied from the hopper 185 to the buffer 180 is proportional to the rotation time of the screw 186. When the rotation time of the screw 186, that is, the period from time t1 to time t3 is determined to be constant, a toner replenishment amount can be regulated. After the toner is consumed from a full state to the position of the level sensor 187, toner is supplied from the hopper 185 into the buffer 180 into a full state.

Herein, the case of printing at high coverage is explained. In the high coverage printing, a larger amount of toner is consumed for one sheet of paper than in the low coverage printing. Accordingly, the number of times toner is supplied per time from the hopper 185 into the buffer 180 is larger than in the low coverage printing. Specifically, the toner replenishment amount per fixed time, namely, toner replenishment rate is larger. Therefore, the toner remaining in the buffer 180 and new toner supplied from the hopper 185 are mixed by the number of times more than in the low coverage case. A toner charge distribution is broadened accordingly, thus generating the low-charged toner and the oppositely-charged toner.

<Method of Adjusting Developing Bias>

The low-charged toner and the oppositely-charged toner tend to cause image fogging. However, this image fogging can be prevented by adjusting the developing bias as mentioned below. The adjustment method of the developing bias is here explained. The low-charged toner and oppositely-charged toner increase when new and old toners are frequently mixed. To avoid this, the developing bias should be adjusted when the toner replenishment rate is high, i.e., when the toner is frequently replenished from the hopper 185 into the buffer 180.

Specifically, in the case when a large amount of toner is replenished in the buffer 180 per fixed time, a developing bias that prevents image fogging is set for a period from the time replenishment is made to the time elapsed by a time required for sufficient toner agitation. Then, the developing bias is returned to a normal developing bias. As a reference value to determine which of the developing bias that prevents image fogging and the normal developing bias should be set, a replenishment rate determination value IRin or an accumulated replenishment rate determination value SRin is used.

Herein, the replenishment rate determination value IRin is obtained by the following expression:

$$IRin = Rin - Rth$$

$$Rin = Nr \times Rep / ITr$$

where

"Nr" is the number of times toner is replenished within a clocking time of preset length, "Rep" is an amount of toner to be replenished each time, "ITr" is the length of the preset clocking time, and "Rth" is a value set as a replenishment rate at which toner can be agitated sufficiently.

This replenishment rate determination value IRin is used to compare the amount of toner replenished per predetermined time with a set value of the toner replenishment rate wherein sufficient agitation is possible. When IRin is a positive value, it indicates that agitation of the toner replenished within the clocking time has not been sufficiently conducted. Thus, the developing bias that prevents image fogging is set. On the other hand, when IRin is a negative value or zero, agitation of the toner replenished within the clocking time has been sufficiently conducted. Accordingly, the normal developing bias can be set to perform development.

The accumulated replenishment rate determination value "SRin" is obtained by the following expression:

$$SRin=\Sigma(Rin-Rth)$$

where a start point of the sum is the time when a value of (Rin−Rth) becomes positive, and an end point of the sum is the time when SRin becomes equal to or smaller than zero (SRin≦0).

The value of the accumulated replenishment rate determination value SRin remains positive, as mentioned later, for a period from the toner replenishment to the completion of sufficient toner agitation. Accordingly, when SRin is a positive value, the developing bias that prevents image fogging is set. On the other hand, when SRin is a negative value or zero, the normal developing bias can be set.

Figure 4:
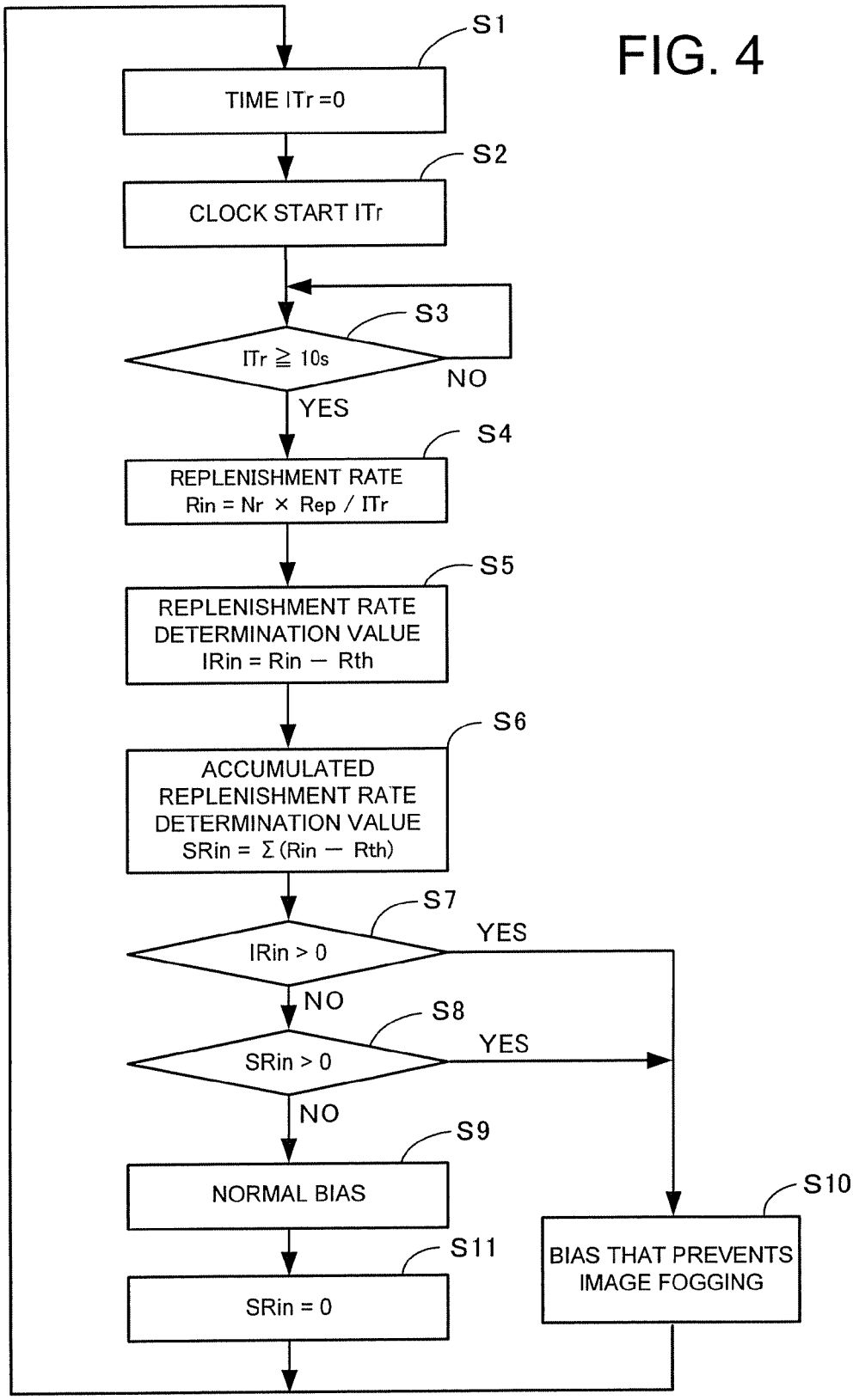
FIG. 4 is a flowchart showing a manner of adjusting a developing bias.

Herein, FIG. 4 shows a flowchart to adjust the developing bias. The process in the flowchart in FIG. 4 will be executed at all times during use of the image forming apparatus 100.

Time ITr is first initialized (S1). Measurement of the time ITr is then started (S2). If the time ITr has not yet got to 10 seconds, the step S3 is repeated. If the time ITr has got to 10 seconds, the flow advances to S4. A toner replenishment rate Rin is calculated (S4) by the following expression:

$$Rin=Nr\times Rep/ITr$$

where

"ITr" is a clocking time from S2 to S3(YES),

"Nr" is the number of times of replenishment for 10 seconds from S2 to S3(YES), and "Rep" is the amount of toner to be replenished each time.

Specifically, the replenishment rate Rin is a replenishment amount of toner replenished from the hopper 185 into the buffer 180 for a lapse of the time ITr. It is to be noted that the time ITr is previously set to 10 seconds, which is the time for which toner replenishment is performed twice or more during normal use. The value, 10 seconds, may be appropriately set when specifications are decided.

Subsequently, the replenishment rate determination value IRin is calculated (S5) by the following expression:

$$IRin=Rin-Rth$$

where

"Rin" is the toner replenishment rate calculated in S4, and

"Rth" is a value set as the replenishment rate at which the toner can be agitated sufficiently.

It is to be noted that the value of Rth may be set to for example 0.06 g/s. This value, 0.06 g/s, may appropriately set when specifications are decided.

The accumulated replenishment rate determination value SRin is calculated (S6) by the following expression;

$$SRin=\Sigma(Rin-Rth)$$

where a start point of the sum is the time when a value of (Rin−Rth) becomes positive, and an end point of the sum is the time when SRin becomes equal to or smaller than zero (SRin≦0).

Herein, Rin and Rth are the same as those used in S5. Addition performed herein is to add values of (Rin−Rth) obtained from the time when (Rin−Rth) becomes a positive value. This addition is repeated until the value of SRin itself becomes negative. As mentioned later, for the period from the time when toner replenishment is made to the time sufficient toner agitation is made, the accumulated replenishment rate determination value SRin remains positive. Since the value of SRin is reset in S11 as described later, SRin will not become negative by this addition.

Herein, the accumulated replenishment rate determination value SRin is sum of values of (Rin−Rth) calculated every 10 seconds. A value of (Rin−Rth) is positive or negative according to whether the toner replenishment amount for past 10 seconds is large or small. Consequently, the accumulated replenishment rate determination value SRin may become positive or negative. The accumulated replenishment rate determination value SRin at an initial stage is zero. The "initial stage" means a product shipment stage or a replacement stage of the developing device.

Subsequently, it is determined whether or not image fogging is likely to be caused based on the toner replenishment amount. This determination is made in two stages. The first-stage determination is performed by the replenishment rate determination value IRin (S7). When IRin is a positive value, that is, when the toner replenishment amount for 10 seconds exceeds the reference value Rth, the developing bias is set to a value that causes no image fogging (S10). If not, the flow advances to S8.

The second-stage determination is performed by the accumulated replenishment rate determination value SRin (S8). When SRin is positive, the developing bias is set to a value that causes no image fogging (S10). If not, the normal developing bias is set (S9). Following S9, the accumulated replenishment speed determination value SRin is reset (SRin=0) (S11). SRin is to ensure the period needed for sufficient toner agitation from the toner replenishment when a large amount of toner has been replenished. Thus, negative values of (Rin−Rth) do not need to be accumulated. In this way, the developing bias is adjusted. This adjustment of developing bias is conducted at all times during use of the image forming apparatus 100 and hence this flow is repeated.

In this two-stage determination, the replenishment rate determination value IRin (S7) and the accumulated replenishment rate determination value SRin (S8) are used as a criterion of determination. Herein, if IRin or SRin is positive, the developing bias that prevents image fogging is set (S10). Furthermore, if IRin and SRin are both negative values or zero, the normal developing bias is set (S9). Even when the developing bias that prevents image fogging is set once, if the subsequent toner replenishment amount is small, IRin and SRin both become negative values or zero. In other words, it is returned to the normal developing bias.

The second-stage determination is made on the assumption that a large amount of toner has been replenished at a time. Here, assuming that a large amount of toner has been replenished, the replenishment rate determination value IRin and the accumulated replenishment rate determination value SRin become positive. Therefore, the value of IRin is checked (S7) and the developing bias that prevents image fogging is set (S10). For subsequent 10 seconds (S1 to S3), when it is determined that a replenishment amount is small because the amount of toner in the buffer 180 is sufficient, IRin becomes a negative value. However, a large amount of toner has been replenished for previous 10 seconds and thus the accumulated replenishment rate determination value SRin still remains a positive value (S8: YES). Therefore the developing bias that prevents image fogging keeps on being set (S10). After the determinations (S7 and S8) in 10-sec intervals are repeated several times, the normal developing bias (S9) is set when the accumulated replenishment rate determination value SRin becomes a negative value or zero. Specifically, for a period from the time when a large number of toner is replenished to the time when it can be regarded that the toner has been agitated sufficiently, the developing bias that prevents image fogging is set (S10). Otherwise, the normal developing bias (S9) is set. This is because insufficient toner agitation is likely to cause image fogging. It is therefore preferable to additionally perform the determination based on the accumulated replenishment rate determination value SRin.

However, it may be determined based on only the replenishment rate determination value IRin or only the accumulated replenishment rate determination value SRin whether or not image fogging is easily caused. In that case, the step S7 or S8 is omitted. Also in this case, image fogging is less caused as compared with the conventional case.

To find the replenishment rate determination value IRin and the accumulated replenishment rate determination value SRin, the same value is used as Rth. However, different values may be used as Rth between the replenishment rate determination value IRin and the accumulated replenishment rate determination value SRin.

<Cause of Image Fogging>

Figure 5:
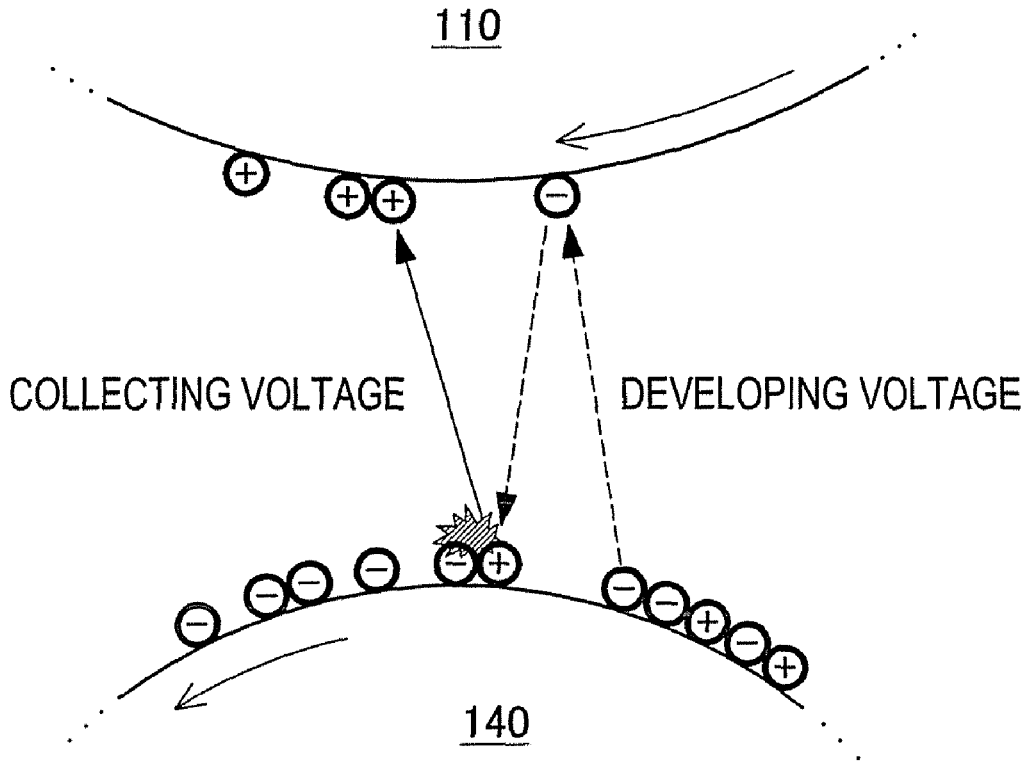
FIG. 5 is a view to explain the case where normally-charged toner flicks oppositely-charged toner by the developing bias.

A method of adjusting the developing voltage Vmin of the developing bias that prevents image fogging is explained below. A mechanism of causing image fogging is first explained with reference to FIG. 5. FIG. 5 shows motion of toner particles when the developing bias is applied between the photoconductor 110 and the developing roller 140. Herein, the normally-charged toner is charged negatively and the oppositely-charged toner is charged positively.

For the image area, normally-charged toner particles fly from the surface of the developing roller 140 to the surface of the photoconductor 110 by the developing voltage Vmin. Then, at least part of the normally-charged particles fly back from the surface of the photoconductor 110 to the surface of the developing roller 140 by the collecting voltage Vmax. At that time, the returned normally-charged particles may collide with low-charged and oppositely-charged toner particles on the developing roller 140, thereby flicking the low-charged and the oppositely-charged particles off the surface of the developing roller 140.

The following explanation is given to subsequent motion of the toner particles flicked away. The motion of the low-charged particles is first explained. The flicked low-charged particle receives a force in the same direction as the normally-charged particle by the developing bias. Thus, the low-charged toner particle is caused to fly toward the photoconductor 110 by the developing voltage Vmin. The low-charged toner is lower in charge quantity than the normally-charged toner and hence is more likely to adhere to the background area as compared with the normally-charged toner. Once the low-charged toner adheres to the background area of the electrostatic latent image on the photoconductor 110, it could not be collected by the collecting voltage Vmax because of the low charge quantity. Furthermore, there is little possibility that the low-charged particle adhered to the background area is flicked by a normally-charged particle again. In other words, the low-charged toner once adhering to the surface of the photoconductor 110 is likely to stay thereat.

The motion of oppositely-charged particles is explained below. The returned normally-charged particle collides with oppositely-charged particles on the developing roller 140 while the collecting voltage Vmax is applied between the photoconductor 110 and the developing roller 140. The oppositely-charged particle receives the force in the opposite direction to the normally-charged toner and thus receives the force to move toward the photoconductor 110 by the electric field by the collecting voltage Vmax. Accordingly, the oppositely-charged particle flicked will directly fly toward the photoconductor 110.

The oppositely-charged toner is easy to adhere to the background area but hard to adhere to the image area because the oppositely-charged toner is charged with an opposite polarity to the normally-charged toner. On the other hand, the normally-charged toner is easy to adhere to the image area but hard to adhere to the background area. In other words, the oppositely-charged toner is more likely to adhere to the background area as compared with the normally-charged toner. Furthermore, once the oppositely-charged toner adheres to the background area of the electrostatic latent image on the photoconductor 110, it is difficult to collect the oppositely-charged toner having the low charge quantity by the developing voltage Vmin. This is because there hardly comes a normally-charged toner particle that can flick the adhering oppositely-charged toner again.

In the case where such low-charged or oppositely-charged toner adhere to the background area of the electrostatic latent image on the photoconductor 110, there is little means for removing them. Thus, such toner may cause image fogging on the paper.

To solve the defects, the developing voltage Vmin has to be adjusted to prevent the normally-charged toner from flying in the background area. Then, the normally-charged toner will be unlikely to flick the low-charged toner and the oppositely-charged toner by the collecting voltage Vmax. This makes it possible to restrain the low-charged toner and the oppositely-charged toner from flying in the background area. Consequently, image fogging in the background area can be prevented.

<Conditions Under which Toner does not Fly>

Figure 6:
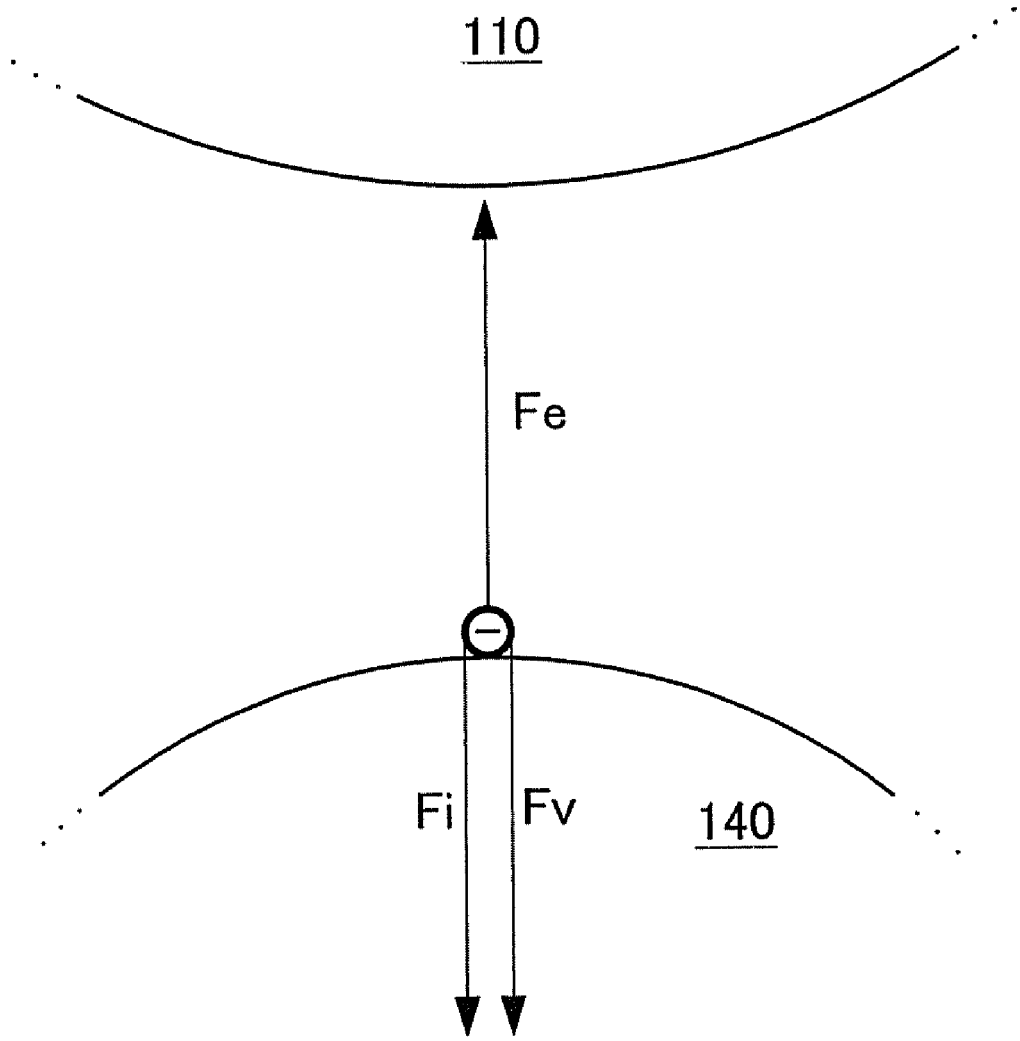
FIG. 6 is a view showing forces imparted on the toner adhered to the developing roller while a developing voltage is applied to the toner.

Herein, the conditions under which the normally-charged toner does not fly are explained below. Each force acting on toner is first explained. Each force the toner receives is explained with reference to FIG. 6. FIG. 6 shows the case where a toner particle adhering to the developing roller 140 receives an electric field induced by the developing voltage Vmin. At that time, the toner receives a coulomb force Fe from the electric field generated by the developing voltage Vmin (hereinafter, simply referred to as "coulomb force"). Furthermore, the toner receives an image force Fi from the developing roller 140 and also receives a mechanical adhesion force Fv containing Van der Waals force as a principal component from the developing roller 140 (hereinafter, simply referred to as "Van der Waals force").

The coulomb force Fe acts in a direction to move from the developing roller 140 toward the photoconductor 110. On the other hand, the image force Fi acts in an opposite direction to the coulomb force Fe. Similarly, the Van der Waals force Fv acts in an opposite direction to the coulomb force Fe. That is, the coulomb force Fe acts on the toner to separate from the developing roller 140 and the image force Fi and the Van der Waals force Fv act on the toner not to separate from the developing roller 140.

Accordingly, a resultant force F of the forces acting on the toner while the toner adhering to the developing roller 140 receives the developing voltage Vmin is represented by the following expression assuming that the direction to move from the developing roller 140 toward the photoconductor 110 is positive:

$$F=Fe-Fi-Fv$$

The toner is caused to fly in case of F>0 but not caused to fly in case of F≦0. In other words, the resultant force F is a separation force whereby to determine whether or not the toner separates from the developing roller 140 (hereinafter, referred to as a "separation force F"). It is to be noted that gravity is not taken into consideration.

<Each Force Acting on Toner>

Each force is explained below. The coulomb force Fe is explained first. Assuming that the charge quantity of the toner is "q", the coulomb force Fe imparted on the toner in the electric field E is represented by the following equation:

$$Fe=q\cdot E$$

That is, Fe is proportional to the toner charge quantity "q".

The image force Fi is explained. Assuming the toner charge quantity is "q", the image force Fi is given by the following expression (1):

$$Fi=(\epsilon-1)\cdot q^2/\{(\epsilon+1)4\pi\cdot\epsilon 0\cdot D^2\} \quad (1)$$

where

"ϵ" is a relative permittivity of developing roller,

"ϵ0" is a permittivity of air, and

"D" is an average particle size,

"ϵ", "ϵ0", and "D" are known constants.

Herein, a coefficient of $q^2$ in the expression (1) is assumed to be "a". In other words, "a" is defined as the following expression:

$$a=(\epsilon-1)/\{(\epsilon+1)4\pi\cdot\epsilon 0\cdot D^2\}$$

Thus, the image force Fi is represented by the following expression:

$$Fi=a\cdot q^2$$

where "a" is a known constant. The image force Fi is proportional to the square of the toner charge quantity "q". In the following description, the following values are used in calculation.

$$\epsilon=3$$

$$\epsilon 0=8.85\times 10^{-12}\ [\mathrm{F/m}]$$

$$D=6\ [\mu\mathrm{m}]$$

As the Van der Waals force Fv, an experimentally measured value is used. This measurement was performed by use of a measuring apparatus disclosed in KONICA MINOLTA TECHNOLOGY REPORT Vol. 1 (2004), page 15, "The size dependence of toner adhesion force and field detachment properties". This apparatus is arranged to measure the Van der Waals force Fv by vibrating a vibrator to provide vibration acceleration to the toner adhering to the vibrator by electrostatic force. In this measurement, the vibration acceleration is gradually increased to find the vibration acceleration at which the adhering toner separates from the vibrator. Fv can be determined from this value.

This Van der Waals force Fv substantially acts only the toner being adhering to the developing roller 140. In other words, once the toner separates from the developing roller 140, this force Fv hardly acts on the toner unless it adheres to the developing roller 140 again. It was also found from a result of the measurement that Fv does not depend on the toner charge quantity. Thus, Fv is considered to be a constant and expressed as "c" in the following description.

From the above explanation, the resultant force F imparted on the toner adhering to the developing roller 140 and receiving the developing voltage Vmin is represented by the following expression:

$$F = Fe - Fi - Fv$$

$$= -a\cdot q^2 + E\cdot q - c$$

This is a quadratic function of the toner charge quantity "q". Where ϵ>1,

ϵ0>0, and

D2>0, and hence, a>0. Therefore, F is a quadratic upward-convex function having a maximum value at a certain charge quantity "q".

Figure 7:
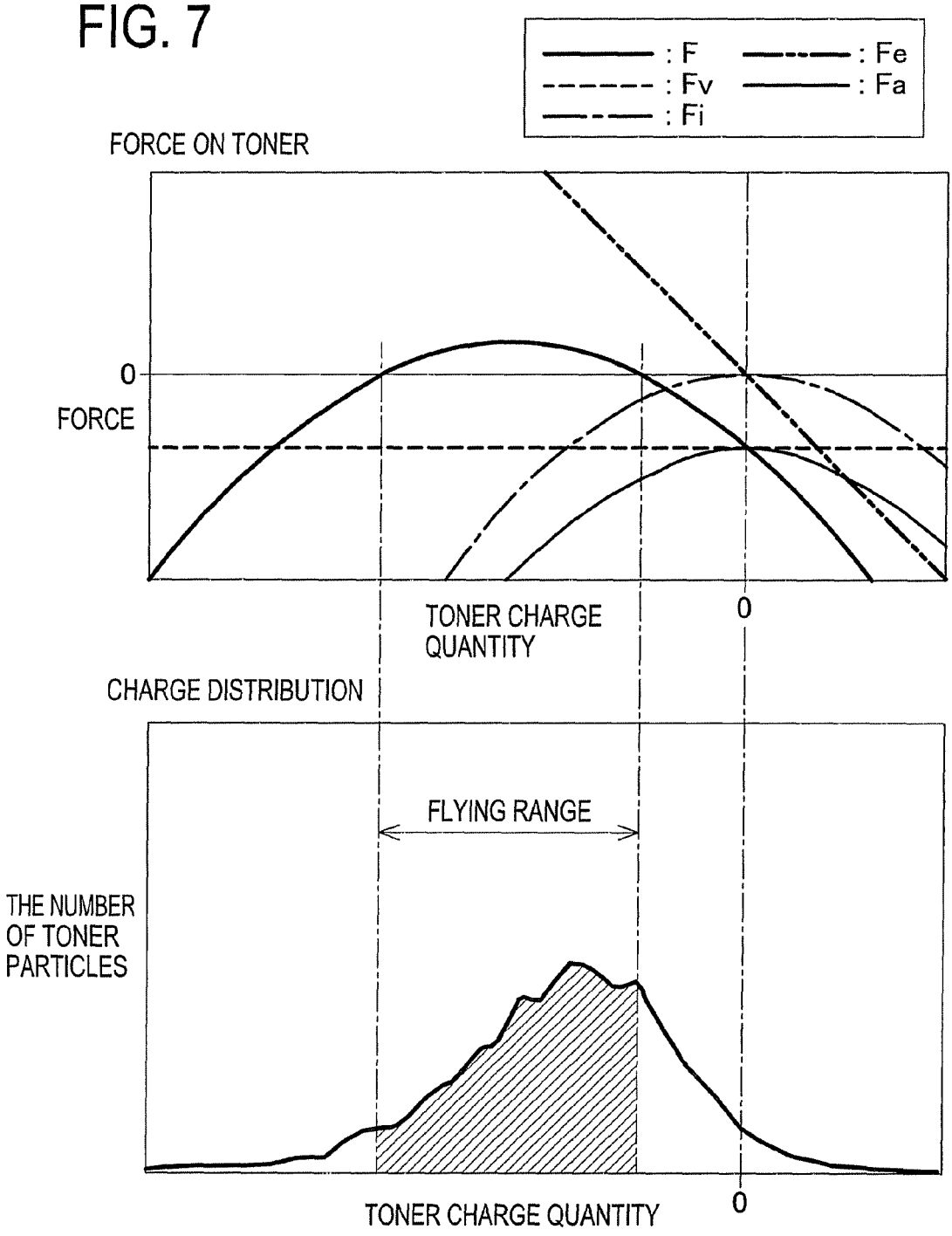
FIG. 7 is a view showing a relationship between the charge quantity of the toner adhered to the developing roller and forces imparted on the toner.

Herein, FIG. 7 shows, in an upper graph, a relationship between the toner charge quantity "q" and each force acting on the toner. The upper graph of FIG. 7 shows the separation force F, the coulomb force Fe, the image force Fi, the Van der Waals force Fv, and the adhesion force Fa. A lateral axis indicates the toner charge quantity and a vertical axis indicates the forces acting on the toner. Herein, the adhesion force Fa is a resultant of the image force Fi and the Van der Waals force Fv as defined by the following expression.

$$Fa=Fi+Fv$$

The adhesion force Fa is the force that causes toner to adhere to the developing roller 140. Using this adhesion force Fa, the separation force F is represented by the following expression.

$$F = Fe - Fi - Fv$$

$$= Fe - Fa$$

As is obvious from this expression, the separation force F is positive when the coulomb force Fe exceeds the adhesion force Fa, and the toner flies.

A lower graph in FIG. 7 shows a toner charge distribution. A lateral axis indicates the toner charge quantity and a vertical axis indicates the number of toner particles having the corresponding charge quantity in the buffer 180. Toner fly in a positive range of the separation force F in the upper graph in FIG. 7. The toner included in the corresponding range (a hatched region) receive a force from the electric field generated by the developing voltage Vmin and fly from the developing roller 140 toward the photoconductor 110. In other words, the area of the hatched region is proportional to the number of flying toner particles.

The coulomb force Fe is proportional to the charge quantity "q" as mentioned above. On the other hand, the Van der Waals force Fv is a constant independent of the charge quantity "q". The image force Fi, the adhesion force Fa, and the separation force F are quadratic functions of the charge quantity "q". Since the separation force F is a quadratic function of the charge quantity "q", there is a certain charge quantity "q" at which a separation force F takes a peak value in the toner charge distribution. The toner corresponding to the maximum value of this quadratic function, namely, the toner having the charge quantity "q" corresponding to the peak separation force F is the toner most likely to fly.

Figure 8:
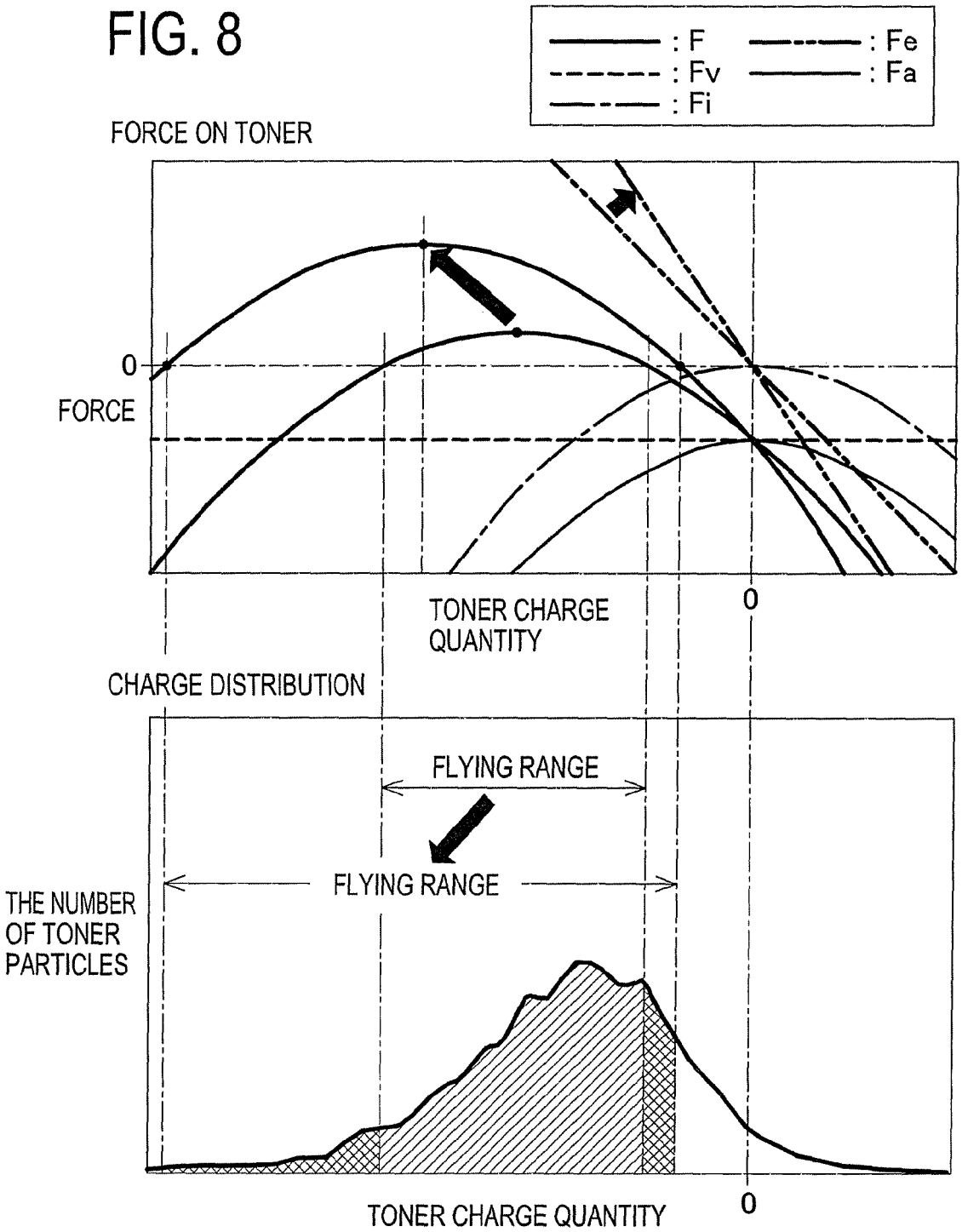
FIG. 8 is a view to explain the forces imparted on the toner and changes in the charge quantity of the flying toner in the case where an electric field is increased.

When the electric field intensity E is changed, however, the different toner from the toner easiest to fly before the change of the electric field intensity E corresponds to the toner most likely to fly, that is, the toner having the maximum separation force F. For instance, when the electric field intensity E is increased as shown in FIG. 8, the toner having a larger absolute value of the charge quantity is most likely to fly. In FIG. 8, an extreme value of the separation force F shifts obliquely. Specifically, when the electric field intensity is increased, the toner having a larger absolute value of the charge quantity corresponds to the "toner most likely to fly". This corresponds to the extreme value of the quadratic function changing with the coefficient of the linear term of the function. Furthermore, as the electric field intensity is increased, the toner flying range in the charge distribution is widened. The toner having a larger charge quantity is more likely to fly. Inversely, as the electric field intensity E is decreased, the toner having a smaller charge quantity is more likely to fly. The toner most likely to fly has the charge quantity "q" defined in the range of the charge distribution of the normally-charged toner.

As explained above, if the toner having the charge quantity "q" at which the toner is most likely to fly is not flown from the developing roller 140 toward the photoconductor 110, other toner having different charge quantities "q" also cannot be flown. Accordingly, it is only necessary to find the conditions under which the toner having the charge quantity "q" making the toner most likely to fly does not fly from the developing roller 140.

Herein, the image force Fi is the force whose intensity is determined based on the toner particle size D and the charge quantity "q". The Van der Waals force is the force determined based on environmental conditions such as humidity. That is, these are uncontrollable factors. On the other hand, the coulomb force Fe is controllable. Accordingly, setting of the electric field intensity at an appropriate value causes the toner to stay adhering to the developing roller 140. In other words, it is only necessary to make the separation force F negative.

Herein, the conditions under which the toner does not fly in the background area are explained below. Setting the above electric field intensity makes the toner difficult to fly in the background area. Specifically, the condition of $F \leqq 0$ is set, thereby restraining the toner from flying. The developing voltage Vmin is therefore set to generate such electric field E for the background area to satisfy the following expression.

$$Fe = q \cdot E \leqq Fa$$

Too high voltage causes the toner to fly in the background area and, inversely, too low voltage does not cause the toner to fly in the image area, that is, development itself will not be conducted.

Herein, a boundary between a condition which causes the toner to fly and a condition which does not cause the toner to fly is determined. The boundary whether or not the toner can fly is at F=0. Accordingly, the electric field intensity Epump for F=0 is calculated by the following expression:

$$E\text{pump} = a \cdot q + c/q$$

By differentiating this by the toner charge quantity "q", the charge quantity "q" at which the toner is most likely to fly is determined. "q" is calculated as follow:

$$q = 1.1 \times 10^{-14}\ [\text{C}]$$

Epump at this time is determined by substituting a value of "q":

$$E\text{pump} = 2.8\ [\text{MV/m}]$$

Herein, a shortest distance (DS) between the photoconductor 110 and the developing roller 140 is 130 μm. Thus, an effective developing voltage |Vmin−Vb| which forms an electric field for the background area is 360V. Vb is a potential of the background area.

Figure 9:
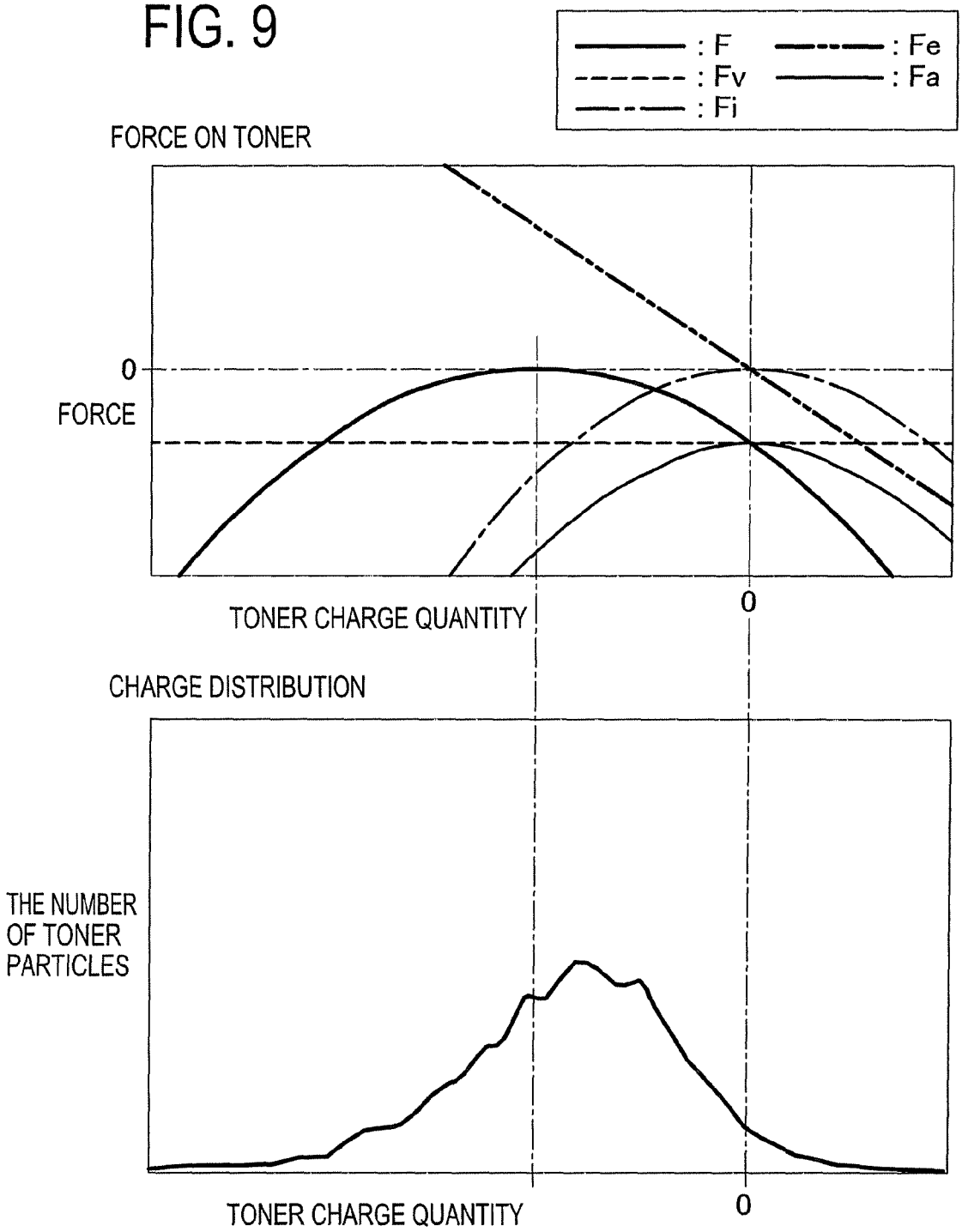
FIG. 9 is a view to explain a relationship between the critical charge quantity by which the toner adhered to the developing roller does not fly and the forces imparted on the toner.

When the effective developing voltage |Vmin−Vb| for the background area is decreased, even the toner most likely to fly is prevented from flying in the background area. In other words, as the developing voltage Vmin is decreased, the electric field intensity is weakened, thus causing the toner to stay. This state is shown in an upper graph in FIG. 9. At this electric field intensity, all the toner particles do not fly. Lower graphs in FIGS. 8 and 9 show the toner charge distribution as shown in the lower graph in FIG. 7.

<Developing Bias and Forces Imparted on Toner>

Figure 10:
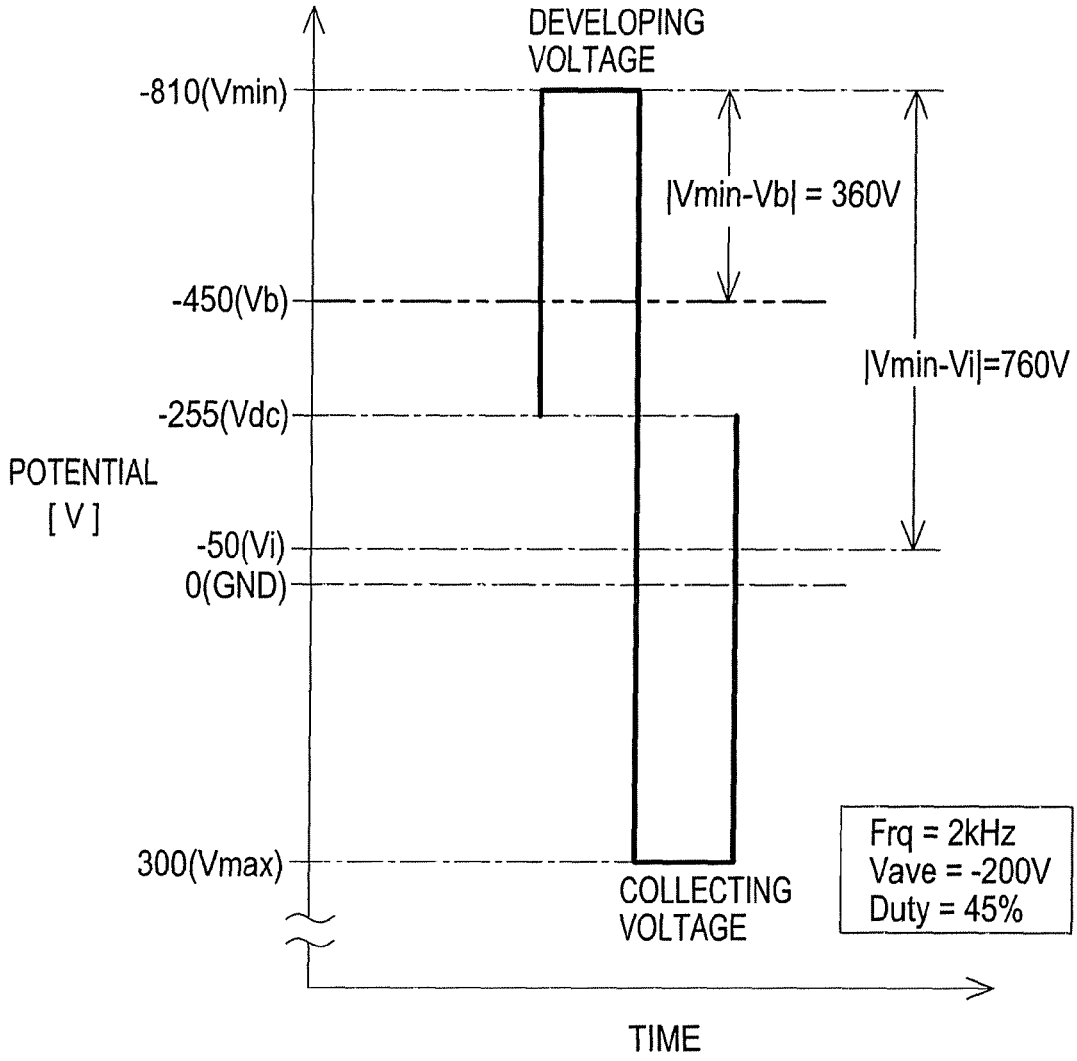
FIG. 10 is a view to explain the developing bias of the present invention.

The following explanation will be given to the developing bias to be applied by the voltage application section 190 in this embodiment. The voltage application section 190 serves not only to apply the developing bias but also to control for determining a set value of the developing bias. The developing bias in this embodiment is shown in FIG. 10, in which a lateral axis indicates the time and a vertical axis indicates the potential. In FIG. 10, Vmin denotes the developing voltage, Vmax denotes the collecting voltage, Vb denotes the potential of the background area, Vi denotes the potential of the image area, and Vdc denotes a direct current component of the developing bias. Frq is the frequency of developing bias, Vave is the time average of developing bias, and Duty is the ratio of the application time of the developing voltage Vmin to the total time.

Herein, a relationship between the developing bias and the forces imparted on the toner will be explained about the case where the developing voltage Vmin is applied. Since the potential is different between the background area and the image area of the latent image, the potential difference between the photoconductor 110 and the developing roller 140 is different between the background area and the image area. Specifically, the effective developing voltage for the background area is |Vmin−Vb| and the effective developing voltage for the image area is |Vmin−Vi|.

The image area under application of the developing voltage Vmin is explained below. The toner receive the force in a direction to move from the developing roller 140 toward the photoconductor 110 by the electric field intensity E generated by the effective developing voltage |Vmin−Vi| for the image area. The toner on the developing roller 140 is therefore caused to fly toward the photoconductor 110. The effective developing voltage |Vmin−Vi| for the image area is 760V.

The background area under application of the developing voltage Vmin is explained below. The toner receives the force in a direction to move from the developing roller 140 toward the photoconductor 110 by the electric field intensity E generated by the effective developing voltage |Vmin−Vb| for the background area. However, the toner on the developing roller 140 does not fly toward the photoconductor 110. This is because, as shown in the upper graph in FIG. 9, the electric field intensity E generated by the effective developing voltage |Vmin−Vb| for the background area is not enough to cause the toner to fly. Herein, the effective developing voltage |Vmin−Vb| for the background area is 360V.

Figure 11:
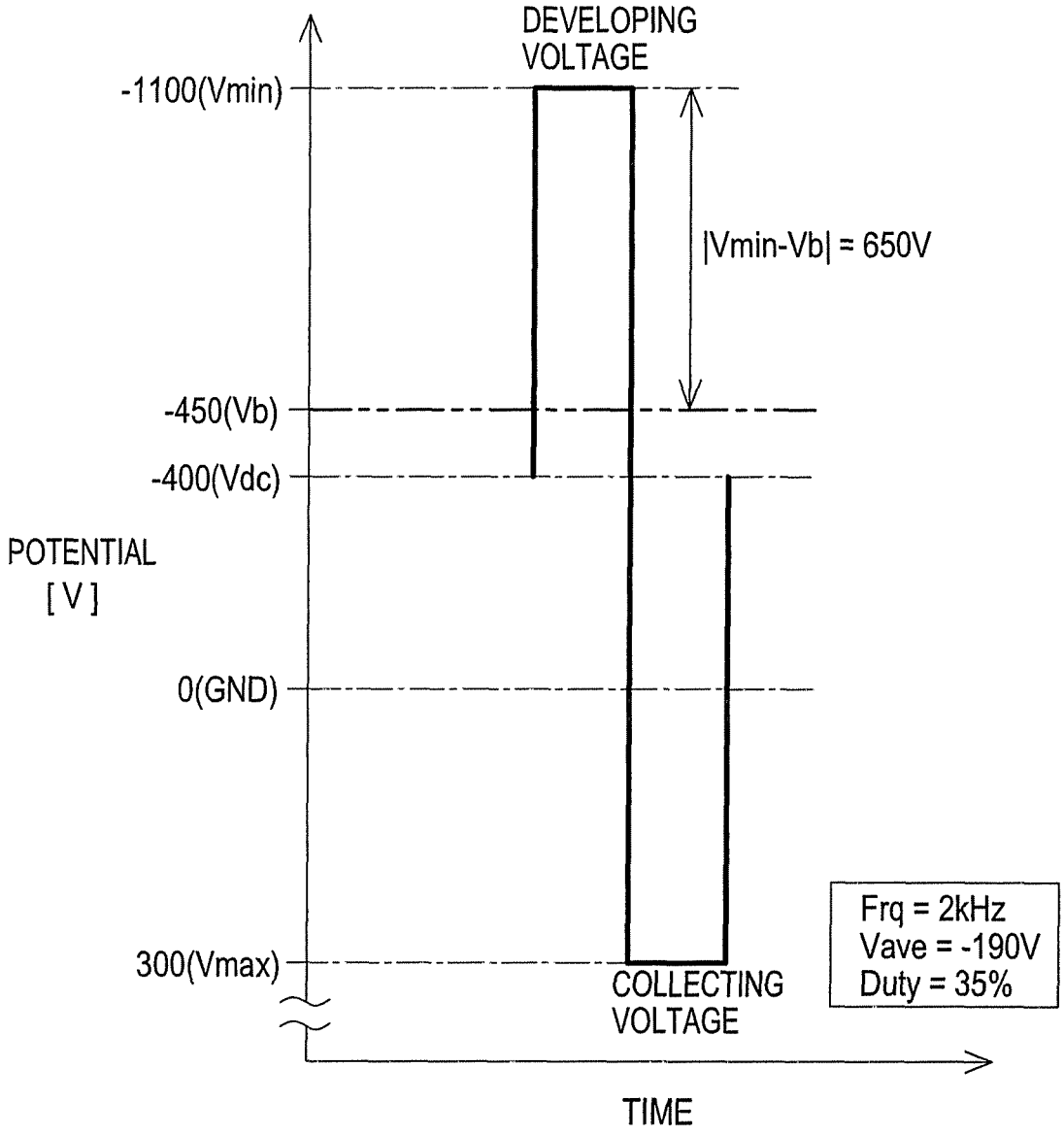
FIG. 11 is a view to explain a conventional developing bias.

The developing bias in this embodiment is smaller in absolute value of developing voltage Vmin as compared with the conventional developing bias shown in FIG. 11. Other conditions are unchanged. Accordingly, the effective developing voltage |Vmin−Vb| for the background area is also reduced from 650V to 360V. The average potential is also reduced in absolute value in association with the decrease in the developing voltage Vmin.

As explained above, all of the normally-charged toner, the low-charged toner, and the oppositely-charged toner does not fly in the background area. On the other hand, the low-charged toner and the oppositely-charged toner as well as the normally-charged toner fly in the image area. At that time, the number of toner particles caused to fly is sufficient because even when the flying range is changed as shown in the lower graph in FIG. 8, the number of toner particles within the flying range does not largely change. Thus, no image fogging is caused. The density in the image area is proper.

<Test Results on Developing Bias>

The following explanation is given to the results of the experiment conducted about the developing bias of the image forming apparatus 100 of this embodiment. This experiment was made to measure image fogging by variously changing the developing voltage Vmin. The image fogging was measured in such a manner that the toner on the photoconductor 110 was peeled by a booker tape, adhering it on a paper (Konica Minolta, J paper), and measuring C* with a color meter CR241 manufactured by Konica Minolta. Furthermore, the experiment used the cyan toner which had been used to print 500 sheets at a printing rate of 5% and hence deteriorated to some extent.

As the result of the experiment, the color ΔC* was as follows:

Present embodiment: 0.52

Conventional condition: 2.36

This result proves that the developing bias in the present embodiment could improve the color ΔC* which is a substitution for image fogging on the photoconductor 110 by about four or five times that in the conventional condition.

Figure 12:
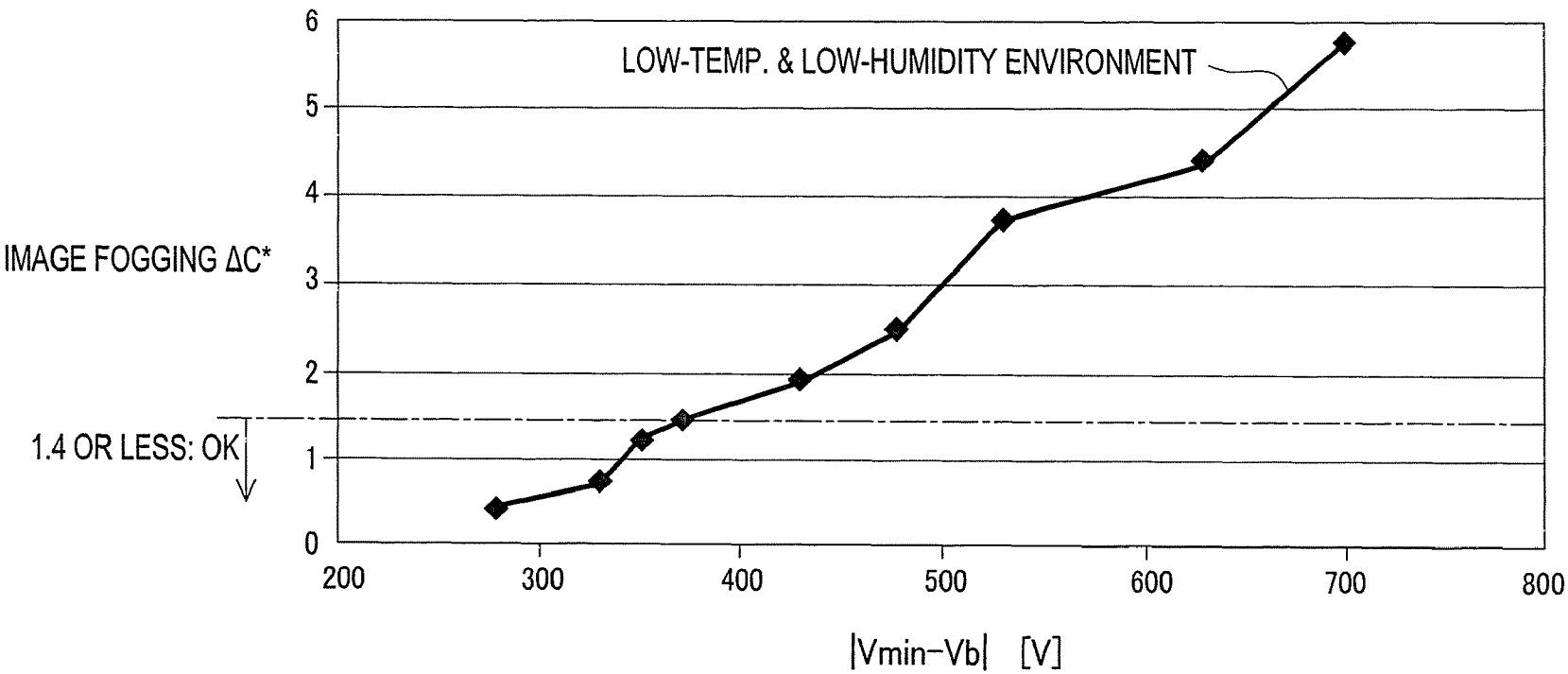
FIG. 12 is a view showing a relationship between image fogging and an absolute value of a difference between a developing voltage and a potential of the background area.

FIG. 12 shows a relationship between the developing voltage and the image fogging color ΔC*, in which a lateral axis indicates the effective developing voltage |Vmin−Vb| for the background area and a vertical axis indicates the color ΔC* which is a substitute for image fogging. Herein, a low-temperature and low-humidity environment is exemplified. In FIG. 12, as a difference between the developing voltage Vmin and the potential Vb of the background area is decreased, the color ΔC* which is a substitute for image fogging becomes smaller. This shows that image fogging is more unlikely to be generated as the effective developing voltage |Vmin−Vb| for the background area is smaller.

As explained above, the experimental results support that the image fogging in the background area could be restrained by adjusting the developing voltage Vmin to reduce the effective developing voltage |Vmin−Vb| for the background area.

<Developing Bias to be Set>

A value of the developing voltage Vmin to be set as the developing bias will be explained below. In the electric field intensity Epump just barely causing the toner to fly, F=Fe−Fa=0 and thus the following relation is established.

$$q \cdot Epump = Fa$$

Accordingly, Epump is derived as below.

$$Epump = Fa/q$$

The voltage Vpump forming this electric field intensity Epump is represented by the following expression:

$$Vpump = Fa \cdot d/q$$

where "d" is the interval between the photoconductor and the developing roller.

Therefore, in order to cause the toner to fly in the image area, the value of the developing voltage Vmin is set to make the effective developing voltage |Vmin−Vi| for the image area larger than the voltage Vpump. Simultaneously, in order not to cause the toner to fly in the background area, the value of the developing voltage Vmin is set to make the effective developing voltage |Vmin−Vb| for the background area smaller than the voltage Vpump.

Accordingly, the developing voltage Vmin is set to satisfy the following relation for the image area of the electrostatic latent image on the photoconductor 110:

$$|Vmin - Vi| > Fa \cdot d/q$$

where "Vi" is a potential of the image area, "Fa" is an adhesion force acting on the toner adhering to the developing roller, "d" is the interval between the photoconductor and the developing roller, and "q" is an average charge quantity of the toner. At this time, the toner flies in the image area.

Furthermore, the developing voltage Vmin is set to satisfy the following relation for the background area of the electrostatic latent image on the photoconductor 110;

$$|Vmin - Vb| \leqq Fa \cdot d/q$$

where "Vb" is a potential of the background area.

At this time, the toner does not fly in the background area. The developing voltage Vmin is set to satisfy the above two relations.

Specifically, the developing voltage Vmin has only to be set in a range defined by the following expression.

$$|Vmin - Vb| \leqq Fa \cdot d/q < |Vmin - Vi|$$

Consequently, development in the image area can be made with appropriate density and no image fogging is generated in the background area.

<Results of Durability Test>

A test was conducted on the image forming apparatus of the present embodiment to examine a relationship between image fogging and durability conditions. The results thereof are shown below. In this test, a laser beam printer "Magicolor 5450" by Konica Minolta was used provide that it was altered or adapted to treat the developing bias of the present embodiment. As environmental conditions for use, the temperature was 10° C. and the humidity was 15% relative humidity.

Here, an experimental method is explained. In the experiment, a blank image and a solid image were printed. As mentioned above, during printing of the blank image, no toner is replenished from the hopper 185 into the buffer 180. During printing of the solid image, on the other hand, toner is replenished from the hopper 185 into the buffer 180, thus causing new and old toners to be mixed frequently. In this case, the test was conducted in three manners; a manner in which the developing voltage Vmin remained unadjusted, a manner in which the developing voltage Vmin was adjusted at all times, and a manner in which the developing voltage Vmin was adjusted only under the condition that caused mixing of new and old toners. This procedure is described below. The blank image was first printed on 1000 sheets and then the solid image was printed on 50 sheets. Subsequently, the blank image was printed on 4000 sheets and then the solid image was printed on 50 sheets. At the end of each of the above steps, toner image fogging on each printed sheet was checked. A comparative object was an unused sheet. Results thereof were shown in Table 1.

TABLE 1

| Durability Conditions | Number of printed sheets 0 | 1000 | 50 (Solid image) | 4000 | 50 (Solid image) |
|---|---|---|---|---|---|
| Unadjusted | ◎ | ○ | Δ | ○ | Δ |
| Adjusted at all times | ◎ | ◎ | ◎ | Δ | X |
| Present Embodiment | ◎ | ○ | ○ | ○ | ○ |

◎: Excellent
○: Good
Δ: Allowable Range
X: Very bad

Under the condition that Epump was fixedly set to 4.5 V/m (Unadjusted), the image fogging was unlikely to occur in printing of the blank image but the image fogging was generated on the solid image due to mixing of new and old toners. Under the condition that Epump was fixedly set to 3.0 V/m (Adjusted at all times), the image fogging was unlikely to occur on both the blank image and the solid image. Specifically, even after replenishment of toner from the hopper 185 into the buffer 180, the image fogging can be prevented. However, the image fogging became worse at the time when the number of printed sheets was 5000. That is, durability is low.

This is conceivably because filming of the toner and the external additive is caused on the developing roller 140 and the restriction blade 142. Accordingly, durability of the developing roller 140 and the restriction blade 142 are considered to have been deteriorated. In the case where Epump is always adjusted to 3.0 V/m, the toner will not be caused to fly and flick between the photoconductor 110 and the developing roller 140 in the non-image area. Accordingly, the adhesion force of the residual developing toner to the developing roller remains high, so that the residual developing toner is hard to collect from the developing roller 140 by the supply roller 141. Conceivably, one reason thereof is that the same toner that continues to stay on the developing roller. According to the method using the developing voltage in this embodiment, the image fogging is not generated during printing of not only the blank image but also the solid image. In addition, no filming is caused and good durability is also achieved.

As explained in detail above, the image forming apparatus in the present embodiment is configured to adjust the developing voltage Vmin of the developing bias to cause the toner to fly between the developing roller 140 and the photoconductor 110 for the image area and not to cause the toner to fly therebetween for the background area. As a result, the normally-charged toner does not flick the low-charged toner and the oppositely-charged toner in the background area. It is therefore possible to prevent the low-charged toner and the oppositely-charged toner from adhering to the background area of the electrostatic latent image formed on the photoconductor 110. Furthermore, the low-charged toner and the oppositely-charged toner will not be accumulated in the buffer. Thus, the image forming apparatus capable of restraining image fogging can be realized.

The present embodiment is merely an example and does not limit the present invention. The present invention therefore may be embodied in other specific forms without departing from the essential characteristics thereof. For instance, the electric field intensity may be determined by differentiating the separation force F.

The separation force F acting on the toner on the developing roller 140 while the developing voltage Vmin is applied is given by the following expression.

$$F = Fe - Fi - Fv$$
$$= -a \cdot q^2 + E \cdot q - c$$

By differentiating this by the charge quantity "q", the following expression is obtained.

$$dF/dq = -2a \cdot q + E = 0$$

Hence, the separation force F at q=E/2a takes the following maximum value.

$$(E^2/4a) - c$$

That is, the force acting on the toner adhering to the developing roller 140 under the electric field intensity E is represented by the following expression.

$$F = -a(q - E/2a)^2 + (E^2/4a) - c$$

The electric field intensity E can therefore be set so as not to cause the toner to fly from the developing roller 140 ($F \leqq 0$). In other words, the toner hardly fly at the electric field intensity E at which the maximum value "$(E^2/4a) - c$" is 0. Accordingly, the developing voltage Vmin is set so that the electric field intensity E between the photoconductor 110 and the developing roller 140 satisfies the following relation:

$$(E^2/4a) - c = 0$$

$$E = \pm(4a \cdot c)^{1/2}$$

where "a" is a known value and "c" is an experimentally determined value.

Furthermore, instead of adjusting the developing voltage Vmin, the background-area potential Vb may be adjusted because even this adjustment can also adjust the effective developing voltage |Vmin−Vb| for the background area. In this case, preferably, an exposure light amount to the photoconductor 110 is also increased in association with an increase in the background-area potential Vb.

It may be arranged to count the number of printed sheets and, when a count reaches a predetermined number of printed sheets, adjust the developing voltage Vmin. This is because the toner in the buffer 180 is not deteriorated in the initial state.

In the flowchart in FIG. 4, even when the condition under which the value of the developing voltage Vmin should be changed is established, if such a job as to continuously print the same image is being conducted, it is preferable to wait for the job to finish.

Second Embodiment

A second embodiment will be explained. An image forming apparatus in this embodiment has the same mechanical configuration as that in the first embodiment. Furthermore, the adjustment of the developing voltage Vmin of developing bias will also be conducted along the flow in FIG. 4 as in the first embodiment. A difference from the first embodiment is in a value to set the developing voltage Vmin of the developing bias. In this embodiment, a permissible range is given to the developing voltage Vmin with reference to the voltage forming the electric field intensity at which the toner most likely to fly in the background area is not caused to fly.

Similar to the first embodiment, a threshold value Epump of the electric field intensity at which the toner most likely to fly is caused to fly is used as a reference. Specifically, in the same manner as in the first embodiment, when the developing voltage Vmin is set to satisfy the following relation, the toner does not or hardly fly in the background area:

$$|Vmin-Vb|=Fa\cdot d/q$$

where

"Vb" is a potential of the background area,

"Fa" is an adhesion force acting on the toner adhering to the developing roller, "d" is the interval between the photoconductor and the developing roller, and "q" is an average charge quantity of the toner.

At this time, similar to the first embodiment, the toner will fly in the image area.

Figure 13:
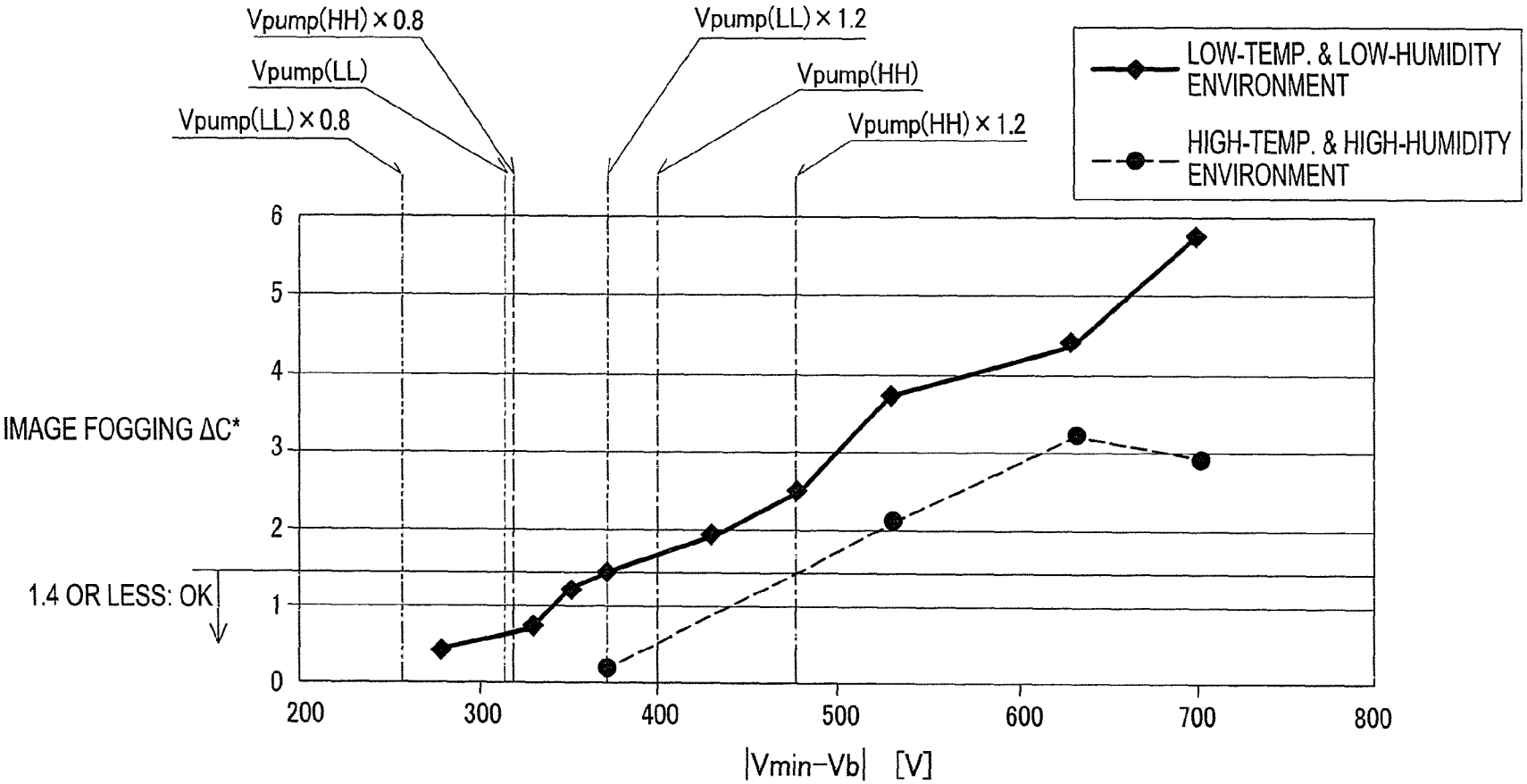
FIG. 13 is a view showing a difference depending on the environment between the image fogging and the absolute value of the difference between the developing voltage and the potential of the background area.

The image forming apparatus in this embodiment is configured to set the developing bias with reference to the aforementioned developing voltage Vmin according to the permissible range of image fogging ΔC*. FIG. 13 is a graph showing a relationship between the developing voltage Vmin and the image fogging ΔC*. This graph also shows a difference between a high-temperature and high-humidity environment and a low-temperature and low-humidity environment. The low-temperature and low-humidity environment is expressed by the same data as in FIG. 12. In both of the high-temperature and high-humidity environment and the low-temperature and low-humidity environment, the image fogging ΔC* is smaller as the value of the effective developing voltage |Vmin−Vb| for the background area is reduced. This result is not inconsistent with the mechanism of image fogging mentioned above.

When the developing voltage Vmin was set to a voltage Vpump (HH) hardly causing the toner to fly under the high-temperature and high-humidity condition, the image fogging ΔC* was about 0.5. When the developing voltage Vmin was set to a voltage Vpump (LL) hardly causing the toner to fly under the low-temperature and low-humidity condition, the image fogging ΔC* was also about 0.5. The value of image fogging ΔC* discriminable to the naked eyes is about 3. Accordingly, the above image fogging level sufficiently falls within the permissible range.

By setting the above developing voltage Vmin, little image fogging occurs in the background area. However, at the above setting, the low-charged toner and the oppositely-charged toner are not discharged from the buffer 180. In other words, the low-charged toner and the oppositely-charged toner remain stored in the buffer 180. On the other hand, since the value of the image fogging ΔC* discriminable to the naked eyes is about 3, the image fogging ΔC* is not needed to be exactly 0.5, that is, it may be set to a loose value. Accordingly, the developing voltage Vmin also may be set in a wide permissible range.

Herein, Vpump (LL) is the voltage hardly causing the toner to fly under the low-temperature and low-humidity condition. Vpump (HH) is the voltage hardly causing the toner to fly under the high-temperature and high-humidity condition. The experimental results show the followings. When the set value of the developing voltage Vmin is increased to be 1.2 times the voltage Vpump (LL) hardly causing the toner to fly under the low-temperature and low-humidity condition, the image fogging ΔC* was 1.4. When the set value of the developing voltage Vmin is increased to be 1.2 times the voltage Vpump (HH) hardly causing the toner to fly under the high-temperature and high-humidity condition, the image fogging ΔC* was also 1.4. The condition that ΔC* is 1.4 or less is sufficient to ensure the quality of a printed material.

On the other hand, when the set value of the developing voltage Vmin is set to be 0.8 times the voltage Vpump (LL) hardly causing the toner to fly under the low-temperature and low-humidity condition, the image fogging ΔC* should be small even though it is not found in the experimental values. Furthermore, the same applies to the case under the high-temperature and high-humidity condition. Thus, Vmin is determined so that the effective developing voltage |Vmin−Vb| for the background area falls within the range of ±20% of Fa·d/q, where "Vb" is the potential of the background area, "Fa" is the adhesion force acting on the toner adhering to the developing roller, "d" is the interval between the image carrier and the developing roller, and "q" is the toner charge quantity.

At this time, the image fogging ΔC* is 1.4 or less. Under this condition, the toner is caused to fly in the image area.

It is to be noted that the present experiment was made to measure image fogging by variously changing the developing voltage Vmin in the same manner as in the first embodiment. Specifically, the image fogging was measured in such a manner that the toner on the photoconductor 110 was peeled by a booker tape, adhering it on a paper (Konica Minolta, J paper), and measuring C* with a color meter CR241 manufactured by Konica Minolta. Furthermore, the experiment used the cyan toner which had been used to print 2500 sheets at a printing rate of 5% and hence deteriorated to some extent.

As explained in detail above, the image forming apparatus in this embodiment is configured to adjust the developing voltage Vmin of the developing bias so as to hardly cause the toner to fly between the developing roller 140 and the photoconductor 110. Accordingly, the number of toner particles caused to fly between the developing roller 140 and the photoconductor 110 decreases. This makes it possible to prevent the normally-charged toner from flicking the oppositely-charged toner which is likely to adhere to the surface of the photoconductor 110. Consequently, the image forming apparatus capable of preventing the image fogging can be realized.

The present embodiment is merely an example and does not limit the present invention. The present invention therefore may be embodied in other specific forms without departing from the essential characteristics thereof. For instance, the permissible range of the developing voltage Vmin may be set according to a desirable value of tolerant image fogging ΔC*.

Furthermore, instead of adjusting the developing voltage Vmin, the background-area potential Vb may be adjusted because even this adjustment can also adjust the effective developing voltage |Vmin−Vb| for the background area. In this case, preferably, an exposure light amount to the photoconductor 110 is also increased in association with an increase in the background-area potential Vb.

It may be arranged to count the number of printed sheets and, when a count reaches a predetermined number of printed sheets, adjust the developing voltage Vmin. This is because the toner in the buffer 180 is not deteriorated in the initial state.

In the flowchart in FIG. 4, even when the condition under which the value of the developing voltage Vmin should be changed is established, if such a job as to continuously print the same image is being conducted, it is preferable to wait for the job to finish.

In the present invention, the voltage application section may set the developing voltage Vmin to the first value when a replenishment amount of toner from the hopper into the buffer per preset time is higher than a predetermined threshold value or when the accumulated replenishment rate determination value SRin is a positive value, and to the second value when the replenishment amount of toner from the hopper into the buffer per preset time is lower than the predetermined threshold value and the accumulated replenishment rate determination value SRin is a negative value.

Also in such a case, it is possible to prevent the low-charged toner and the oppositely-charged toner generated when new toner and old toner are mixed from adhering to a background area of an electrostatic latent image. Furthermore, the low-charged toner and the oppositely-charged toner will not be accumulated in the buffer. This makes it possible to prevent the generation of image fogging for a long period.

In the present invention, the voltage application section may use, as the first value of the developing voltage Vmin, a value that satisfies the following expression for the image area of the electrostatic latent image on image the carrier:

$$|V\min - Vi| > Fa \cdot d/q$$

where

"Vi" is a potential of the image area,

"Fa" is an adhesion force acting on the toner adhering to the developing roller, "d" is an interval between the image carrier and the developing roller, and "q" is a charge quantity of the toner, and that satisfies the following expression for the background area of the electrostatic latent image on image the carrier:

$$|V\min - Vb| \leqq Fa \cdot d/q$$

where "Vb" is a potential of the background area.

In this case, similarly, it is possible to prevent the low-charged toner and the oppositely-charged toner generated when new toner and old toner are mixed from adhering to a background area of an electrostatic latent image. Furthermore, the low-charged toner and the oppositely-charged toner will not be accumulated in the buffer. This makes it possible to prevent the generation of image fogging for a long period.

In the present invention, the voltage application section may use, as the first value of the developing voltage Vmin, a value at which the electric field intensity in the image area of the electrostatic latent image on the image carrier is sufficient to cause the toner to fly from the developing roller to the image carrier in the image area, and at which |Vmin−Vb| for the background area falls within a range of ±20% of Fa·d/q, where "Vb" is a potential of the background area, "Fa" is an adhesion force acting on the toner adhering to the developing roller, "d" is an interval between the image carrier and the developing roller, and "q" is a toner charge quantity.

In this case, similarly, it is possible to prevent the low-charged toner and the oppositely-charged toner generated when new toner and old toner are mixed from adhering to a background area of an electrostatic latent image. Furthermore, the low-charged toner and the oppositely-charged toner will not be accumulated in the buffer. This makes it possible to prevent the generation of image fogging for a long period.

While the presently preferred embodiment of the present invention has been shown and described, it is to be understood that this disclosure is for the purpose of illustration and that various changes and modifications may be made without departing from the scope of the invention as set forth in the appended claims.

REFERENCE SIGNS LIST

100: Image forming apparatus
110: Photoconductor
140: Developing roller
141: Supply roller
180: Buffer
185: Hopper
190: Voltage application section

The invention claimed is:

1. An image forming apparatus of non-contact developing type, the apparatus comprising:

an image carrier;

a developing roller for giving non-magnetic mono-component toner to the image carrier;

a supply roller for supplying the toner to the developing roller;

a buffer for storing and agitating the toner to be supplied to the supply roller;

a hopper for storing the toner to be replenished into the buffer; and a voltage application section for applying a developing bias between the image carrier and the developing roller, wherein the voltage application section applies, as the bias voltage, a developing voltage Vmin for forming an electric field in a direction that causes the toner to fly from the developing roller to the image carrier and a collecting voltage Vmax for forming an electric field in a direction that collects the toner from the image carrier to the developing roller so that the developing voltage and the collecting voltage are alternately repeatedly applied, and the developing voltage Vmin is set to a first value when an accumulated replenishment rate determination value SRin is a positive value, the accumulated replenishment rate determination value SRin being obtained by the following expression:

$$SRin = \Sigma(Rin - Rth)$$

$$Rin = Nr \times Rep/ITr$$

where

"Nr" is the number of times toner is replenished within a clocking time of preset length, "Rep" is an amount of toner to be replenished each time, "ITr" is the length of the preset clocking time, "Rth" is a value set as a replenishment rate at which toner can be agitated sufficiently, a start point of the sum is the time when a value of (Rin−Rth) becomes positive, and an end point of the sum is the time when SRin becomes equal to or smaller than zero (SRin≦0), the first value being a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and the developing voltage Vmin is set to a second value when the accumulated replenishment rate determination value SRin is a negative value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

2. The image forming apparatus according to claim 1, wherein the voltage application section sets the developing voltage Vmin to the first value when a replenishment amount of toner from the hopper into the buffer per preset time is higher than a predetermined threshold value or when the accumulated replenishment rate determination value SRin is a positive value, and to the second value when the replenishment amount of toner from the hopper into the buffer per preset time is lower than the predetermined threshold value and the accumulated replenishment rate determination value SRin is a negative value.

3. The image forming apparatus according to claim 1, wherein the voltage application section uses, as the first value of the developing voltage Vmin, a value that satisfies the following expression for the image area of the electrostatic latent image on image the carrier:

$$|V\text{min}-Vi|>Fa\cdot d/q$$

where

"Vi" is a potential of the image area,

"Fa" is an adhesion force acting on the toner adhering to the developing roller, "d" is an interval between the image carrier and the developing roller, and "q" is a charge quantity of the toner, and that satisfies the following expression for the background area of the electrostatic latent image on image the carrier:

$$|V\text{min}-Vb|\leqq Fa\cdot d/q$$

where "Vb" is a potential of the background area.

4. The image forming apparatus according to claim 1, wherein the voltage application section uses, as the first value of the developing voltage Vmin, a value at which the electric field intensity in the image area of the electrostatic latent image on the image carrier is sufficient to cause the toner to fly from the developing roller to the image carrier in the image area, and at which |Vmin−Vb| for the background area falls within a range of ±20% of Fa·d/q, where "Vb" is a potential of the background area, "Fa" is an adhesion force acting on the toner adhering to the developing roller, "d" is an interval between the image carrier and the developing roller, and "q" is a toner charge quantity.

5. An image forming apparatus of non-contact developing type, the apparatus comprising:

an image carrier;

a developing roller for giving non-magnetic mono-component toner to the image carrier;

a supply roller for supplying the toner to the developing roller;

a buffer for storing and agitating the toner to be supplied to the supply roller;

a hopper for storing the toner to be replenished into the buffer; and a voltage application section for applying a developing bias between the image carrier and the developing roller, wherein the voltage application section applies, as the bias voltage, a developing voltage Vmin for forming an electric field in a direction that causes the toner to fly from the developing roller to the image carrier and a collecting voltage Vmax for forming an electric field in a direction that collects the toner from the image carrier to the developing roller so that the developing voltage and the collecting voltage are alternately repeatedly applied, and the developing voltage Vmin is set to a first value under a first condition that a replenishment amount of toner from the hopper into the buffer per preset time is higher than a threshold value, the first value being a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and to a second value under a second condition that the replenishment amount of toner from the hopper into the buffer per preset time is lower than the threshold value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

6. The image forming apparatus according to claim 5, wherein the voltage application section uses, as the first value of the developing voltage Vmin, a value that satisfies the following expression for the image area of the electrostatic latent image on image the carrier:

$$|V\text{min}-Vi|>Fa\cdot d/q$$

where

"Vi" is a potential of the image area,

"Fa" is an adhesion force acting on the toner adhering to the developing roller, "d" is an interval between the image carrier and the developing roller, and "q" is a charge quantity of the toner, and that satisfies the following expression for the background area of the electrostatic latent image on image the carrier:

$$|V\text{min}-Vb|\leqq Fa\cdot d/q$$

where "Vb" is a potential of the background area.

7. The image forming apparatus according to claim 5, wherein the voltage application section uses, as the first value of the developing voltage Vmin, a value at which the electric field intensity in the image area of the electrostatic latent image on the image carrier is sufficient to cause the toner to fly from the developing roller to the image carrier in the image area, and at which |Vmin−Vb| for the background area falls within a range of ±20% of Fa·d/q, where "Vb" is a potential of the background area, "Fa" is an adhesion force acting on the toner adhering to the developing roller, "d" is an interval between the image carrier and the developing roller, and "q" is a toner charge quantity.

8. An image forming method employed by an image forming apparatus of non-contact developing type comprising an image carrier, a developing roller for giving non-magnetic mono-component toner to the image carrier, a supply roller for supplying the toner to the developing roller, a buffer for storing and agitating the toner to be supplied to the supply roller, and a hopper for storing the toner to be replenished into the buffer, the image forming method comprising:

applying a developing bias between the image carrier and the developing roller is alternately repeated between a developing voltage Vmin for forming an electric field in a direction that causes the toner to fly from the developing roller to the image carrier, and a collecting voltage Vmax for forming an electric field in a direction that collects the toner from the image carrier to the developing roller, setting the developing voltage Vmin to a first value when an accumulated replenishment rate determination value SRin is a positive value, the accumulated replenishment rate determination value SRin being obtained by the following expression:

$$SRin=\Sigma(Rin-Rth)$$

$$Rin=Nr\times Rep/ITr$$

where

"Nr" is the number of times toner is replenished within a clocking time of preset length, "Rep" is an amount of toner to be replenished each time, "ITr" is the length of the preset clocking time, "Rth" is a value set as a replenishment rate at which toner can be agitated sufficiently, a start point of the sum is the time when a value of (Rin−Rth) becomes positive, and an end point of the sum is the time when SRin becomes equal to or smaller than zero (SRin≦0), wherein the first value is a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and setting the developing voltage Vmin to a second value when the accumulated replenishment rate determination value SRin is a negative value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

9. The image forming method according to claim 8, wherein the developing voltage Vmin is set to the first value when a replenishment amount of toner from the hopper into the buffer per preset time is higher than a predetermined threshold value or when the accumulated replenishment rate determination value SRin is a positive value, and to the second value when the replenishment amount of toner from the hopper into the buffer per preset time is lower than the predetermined threshold value and the accumulated replenishment rate determination value SRin is a negative value.

10. The image forming method according to claim 8, wherein the first value of the developing voltage Vmin is a value that satisfies the following expression for the image area of the electrostatic latent image on image the carrier:

$$|Vmin-Vi|>Fa\cdot d/q$$

where

"Vi" is a potential of the image area,

"Fa" is an adhesion force acting on the toner adhering to the developing roller, "d" is an interval between the image carrier and the developing roller, and "q" is a charge quantity of the toner, and that satisfies the following expression for the background area of the electrostatic latent image on image the carrier:

$$|Vmin-Vb|\leqq Fa\cdot d/q$$

where "Vb" is a potential of the background area.

11. The image forming method according to claim 8, wherein the first value of the developing voltage Vmin is a value at which the electric field intensity in the image area of the electrostatic latent image on the image carrier is sufficient to cause the toner to fly from the developing roller to the image carrier in the image area, and at which |Vmin−Vb| for the background area falls within a range of ±20% of Fa·d/q, where "Vb" is a potential of the background area, "Fa" is an adhesion force acting on the toner adhering to the developing roller, "d" is an interval between the image carrier and the developing roller, and "q" is a toner charge quantity.

12. An image forming method employed by the image forming apparatus of non-contact developing type comprising: an image carrier; a developing roller for giving non-magnetic mono-component toner to the image carrier; a supply roller for supplying the toner to the developing roller; a buffer for storing and agitating the toner to be supplied to the supply roller; and a hopper for storing the toner to be replenished into the buffer, the image forming method comprising:

applying a developing bias between the image carrier and the developing roller is alternately repeated between a developing voltage Vmin for forming an electric field in a direction that causes the toner to fly from the developing roller to the image carrier, and a collecting voltage Vmax for forming an electric field in a direction that collects the toner from the image carrier to the developing roller, and setting the developing voltage Vmin to a first value under a first condition that a replenishment amount of toner from the hopper into the buffer per preset time is higher than a threshold value, the first value being a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier, and to a second value under a second condition that the replenishment amount of toner from the hopper into the buffer per preset time is lower than the threshold value, the second value being a value at which the electric field intensity in the image area of the electrostatic latent image on the image carrier and the electric field intensity in the background area of the electrostatic latent image on the image carrier are both sufficient to cause the toner to fly from the developing roller to the image carrier.

13. The image forming method according to claim 12, wherein the first value of the developing voltage Vmin is a value that satisfies the following expression for the image area of the electrostatic latent image on image the carrier:

$$|V\mathrm{min}-Vi|>Fa\cdot d/q$$

where

"Vi" is a potential of the image area,

"Fa" is an adhesion force acting on the toner adhering to the developing roller, "d" is an interval between the image carrier and the developing roller, and "q" is a charge quantity of the toner, and that satisfies the following expression for the background area of the electrostatic latent image on image the carrier:

$$|V\mathrm{min}-Vb|\leqq Fa\cdot d/q$$

where "Vb" is a potential of the background area.

14. The image forming method according to claim 12, wherein the first value of the developing voltage Vmin is a value at which the electric field intensity in the image area of the electrostatic latent image on the image carrier is sufficient to cause the toner to fly from the developing roller to the image carrier in the image area, and at which |Vmin−Vb| for the background area falls within a range of ±20% of Fa·d/q, where "Vb" is a potential of the background area, "Fa" is an adhesion force acting on the toner adhering to the developing roller, "d" is an interval between the image carrier and the developing roller, and "q" is a toner charge quantity.

* * * * *